US006273539B1

(12) United States Patent
Suzuki

(10) Patent No.: US 6,273,539 B1
(45) Date of Patent: Aug. 14, 2001

(54) APPARATUS FOR AND METHOD OF EJECTING INK FOR INKJET PRINTER

(75) Inventor: Shogo Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/233,091

(22) Filed: Jan. 19, 1999

(30) Foreign Application Priority Data

Jan. 22, 1998 (JP) ..... 10-010850

(51) Int. Cl.[7] ..... B41J 29/38; B41J 2/045

(52) U.S. Cl. ..... 347/12; 347/9; 347/10; 347/11; 347/68; 347/70

(58) Field of Search ..... 347/12, 68, 70, 347/9–11

(56) References Cited

U.S. PATENT DOCUMENTS 4,523,200 * 6/1985 Howkins ..... 347/68
4,563,689 * 1/1986 Murakami et al. ..... 347/68
4,611,219 * 9/1986 Sugitani et al. ..... 347/68
5,400,064 * 3/1995 Pies et al. ..... 347/68
5,894,316 * 4/1999 Sakai et al. ..... 347/54

* cited by examiner

*Primary Examiner*—John Barlow
*Assistant Examiner*—An H. Do
(74) *Attorney, Agent, or Firm*—Oliff & Berridge, PLC.

(57) ABSTRACT

An ink ejecting apparatus has: a plate member in which an ink channel is formed; an ink supplying source for supplying the ink to the ink channel; a plurality of ink chambers formed in the plate member and each communicating with the ink channel to allow the ink to be moved from the ink channel into the plurality of ink chambers; a plurality of ink ejecting holes formed in the plate member and communicating with the plurality of ink chambers, respectively, to eject the ink from the plurality of ink chambers; a selection device for selecting more than one ink chamber that actually ejects the ink, from among the plurality of ink chambers; a first control device for reducing a volume of each of the selected ink chambers to actually eject the ink from the selected ink chambers; and a second control device for expanding a volume of non-selected ink chambers to absorb a pressure wave which is caused by a change of the volume of each of the selected ink chambers.

19 Claims, 15 Drawing Sheets

APPARATUS FOR AND METHOD OF EJECTING INK FOR INKJET PRINTER

BACKGROUND OF THE INVENTION

1. Field of the Invention

The present invention relates to an apparatus for and method of ejecting ink to print images or characters.

2. Description of the Related Art

A typical actuator used for control of ink ejection in the inkjet printer has a plurality of ink chambers and a plurality of piezoelectric elements. This actuator is mounted on a head (printer-head). The piezoelectric elements correspond to the ink chambers, respectively. By expansion and restoring (shrinkage) of the piezoelectric elements, the pressure is applied to the ink in the respective ink chambers. The ink chambers communicate with the corresponding ink ejecting holes, respectively. When the pressure is applied, the ink is ejected from the ink chambers to the outside through the ink ejecting holes. The ink ejecting holes are formed on a nozzle plate, which is attached to the actuator. These ink ejecting holes are arranged in the directions of conveyance of recording papers and movement of the head.

When printing, certain ink chambers are selected from among all of the ink chambers, depending on image data to be printed or resolution. Namely, when printing, the ink chambers that actually eject ink are only selected. Then, the volume of the selected ink chambers is only changed by the expansion and shrinkage of the piezoelectric elements. Therefore, the internal pressure of the selected ink chambers is only controlled. Accordingly, the ink is supplied only into the selected ink chambers, and ejected only from the ink ejecting holes corresponding to the selected ink chambers.

However, the ink is supplied though a common ink channel to the ink chambers, respectively. Therefore, one ink chamber and another ink chamber are connected each other through this ink channel. As a result, when the internal pressure of the selected ink chamber is changed by the distortion of the piezoelectric elements, the change of the pressure is propagated through the ink channel as a pressure wave, and reaches other ink chambers, i.e., non-selected ink chambers. As a result, the ink in the non-selected ink chambers leaks to the outside through the corresponding ink ejecting holes. The leakage of the ink can disturb a shape of a meniscus of the ink in the ink ejecting holes. The disturbance of the meniscus causes undesirable changes of the ejecting direction of the ink or impossibility of the ink ejection.

SUMMARY OF THE INVENTION

It is therefore an object of the present invention to provide an apparatus for and method of ejecting ink, which can be prevent leakage of ink from non-selected ink chambers.

To achieve this object, an ink ejecting apparatus according to the present invention has: a plate member in which an ink channel is formed; an ink supplying source for supplying the ink to the ink channel; a plurality of ink chambers formed in the plate member and each communicating with the ink channel to allow the ink to be moved from the ink channel into the plurality of ink chambers; a plurality of ink ejecting holes formed in the plate member and communicating with the plurality of ink chambers, respectively, to eject the ink from the plurality of ink chambers; a selection device for selecting more than one of the plurality of ink chambers that actually ejects the ink; a first control device for reducing a volume of each of the selected ink chambers to actually eject the ink from the selected ink chambers; and a second control device for expanding a volume of each of non-selected ink chambers to absorb a pressure wave which is caused by a change of the volume of each of the selected ink chambers.

When the ink ejection is carried out, the ink is supplied from the ink supplying source to the ink channel. Then, the ink is moved from the ink channel into each ink chamber. Next, the ink chambers that actually eject the ink are selected by the selection device. For example, the selection device selects the ink chambers that actually eject the ink, depending on image data or character data to be printed on the recording medium. Next, the first control device reduces the volume of each selected ink chamber to actually eject the ink. At this time, the pressure wave occurs because of the change of the volume of each selected ink chamber. The pressure wave is transmitted from the selected ink chambers to the non-selected ink chambers. In order to absorb this pressure wave, the second control device expands the volume of each non-selected ink chamber. Therefore, the pressure wave is restrained by the expansion of the volume of each non-selected ink chamber. Accordingly, leakage of the ink from the non-selected ink chambers can be prevented.

The time that the volume of each non-selected ink chamber is expanded is important to improve the capability of the absorption of the pressure wave. According to the present invention, the second control device expands the volume of each non-selected ink chamber at a time that the first control device reduces the volume of each selected ink chamber to actually eject the ink. When the first control device reduces the volume of each selected ink chamber to eject the ink, the amplitude of the pressure wave increases. Therefore, if the volume of each non-selected ink chamber is expanded at this time, it is possible to absorb the pressure wave effectively.

Especially, if the volume of each non-selected ink chamber is expanded at a time that the amplitude of the pressure wave reaches its maximum, it is possible to absorb the pressure wave more effectively.

After the volume of each non-selected ink chamber is expanded, it is necessary to restore this volume. The time that the volume of each non-selected ink chamber is restored is important to improve the performance of the ink ejection. According to the present invention, in order to restore the volume of each non-selected ink chamber, the second control device reduces the volume of each non-selected ink chamber at a time that the amplitude of the pressure wave reaches its minimum. When the amplitude of the pressure is minimum, the internal pressure of the non-selected ink chamber is reduced. Therefore, if the volume of each non-selected ink chamber is restored (reduced) at this time, the internal pressure created by the reduction of the volume of each non-selected ink chamber is absorbed. Accordingly, it is possible to prevent leakage of the ink from the non-selected ink chamber through the corresponding ink ejecting holes.

Furthermore, the second control device may determine the degree of the expansion of the volume of each of the non-selected ink chambers, depending on the number of the selected ink chambers. If the number of the selected ink chambers is large, the amplitude of the pressure wave is large. If the amplitude of the pressure wave is large, the degree of the expansion of the volume of each non-selected ink chamber is large. Therefore, the pressure wave can be effectively absorbed. In contrast, if the number of the selected ink chambers is small, the amplitude of the pressure wave is small. If the amplitude of the pressure wave is small, the degree of the expansion of the volume of each non-selected ink chamber is also small. If the degree of the expansion of the volume of each non-selected ink chamber is small, this volume can be restored quickly. Therefore, it is possible to achieve a rapid ink ejecting action.

Alternatively, the second control device may determine the degree of the expansion of the volume of each non-selected ink chamber, depending on a positional relationship between the selected ink chambers and the non-selected ink chambers.

Furthermore, a plurality of piezoelectric elements may be used to change the volume of each ink chambers. In this case, the plurality of piezoelectric elements may be allocated to the plurality of ink chambers, respectively. Further, in this case, the first control device may include a first driving voltage supplying device for supplying a first driving voltage to the plurality of piezoelectric elements to deflect the plurality of piezoelectric elements, and the second control device may include a second driving voltage supplying device for supplying a second driving voltage to the plurality of piezoelectric elements to deflect the plurality of piezoelectric elements. When changing the volume of the selected ink chamber, the first driving voltage supplying device supplies the first driving voltage to the piezoelectric element corresponding to the selected ink chamber. When changing the volume of the non-selected ink chamber, the second driving voltage supplying device supplies the second driving voltage to the piezoelectric element corresponding to the non-selected ink chamber.

The degree of the change of the volume of the ink chamber is controlled by the degree of the deflection of the piezoelectric element. The degree of the deflection of the piezoelectric element is controlled by the level of the driving voltage. Similarly, the speed of the change of the volume of the ink chamber is controlled by the speed of the deflection of the piezoelectric element. The speed of the deflection of the piezoelectric element is controlled by the gradient of the driving voltage. In the ink ejecting apparatus of the present invention, the first driving voltage supplying device supplies the first driving voltage, which has a first level to be set a degree of a change of the volume of each of the selected ink chambers, and which is varied at a first gradient to be set a speed of the change of the volume of each of the selected ink chambers. In this case, the second driving voltage supplying device may supply the second driving voltage, which has a second level less than the first level, or which is varied at a second gradient smaller than the first gradient. Therefore, the degree of the change of the volume of the non-selected ink chamber is smaller than that of the change of the volume of the selected ink chamber, or the speed of the change of the volume of the non-selected ink chamber is slower than that of the change of the volume of the selected ink chamber. Therefore, it is possible to prevent leakage of the ink from the non-selected ink chamber.

Furthermore, a time that the volume of the ink chamber can be controlled by a time that the driving voltage is supplied to the piezoelectric element. If the second driving voltage device controls a time to supply the second driving voltage such that a time that the degree of the change of the volume of each non-selected ink chamber becomes its maximum matches with a time that the amplitude of the pressure wave reaches its maximum, the pressure wave can be effectively absorbed by the change of the volume of each non-selected ink chamber.

The aforementioned object can be also achieved by an ink ejecting method according to the present invention. The method is carried out in an ink ejecting apparatus comprising: a plate member in which an ink channel is formed; an ink supplying source for supplying the ink to the ink channel; a plurality of ink chambers formed in the plate member and each communicating with the ink channel to allow the ink to be moved from the ink channel into the plurality of ink chambers; a plurality of ink ejecting holes formed in the plate member and communicating with the plurality of ink chambers, respectively, to eject the ink from the plurality of ink chambers.

The method has the processes of: selecting more than one of the plurality of ink chambers that actually ejects the ink; expanding a volume of each of the selected ink chambers to move the ink from the ink channel into each of the selected ink chambers; expanding a volume of each of non-selected ink chambers to absorb a pressure wave which is caused by a change of the volume of each of the selected ink chambers; reducing the volume of each of the selected ink chambers to actually eject the ink from the selected ink chambers; and reducing the volume of each of the non-selected ink chambers to restore the volume of each of the non-selected ink chambers.

The nature, utility, and further feature of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, embodiments of the present invention will be described. In the description set forth hereinafter, the present invention is embodied in an inkjet printer.

I. First Embodiment

Referring to FIG. 1 through 11, a first embodiment of the present invention will be described.

Figure 1:
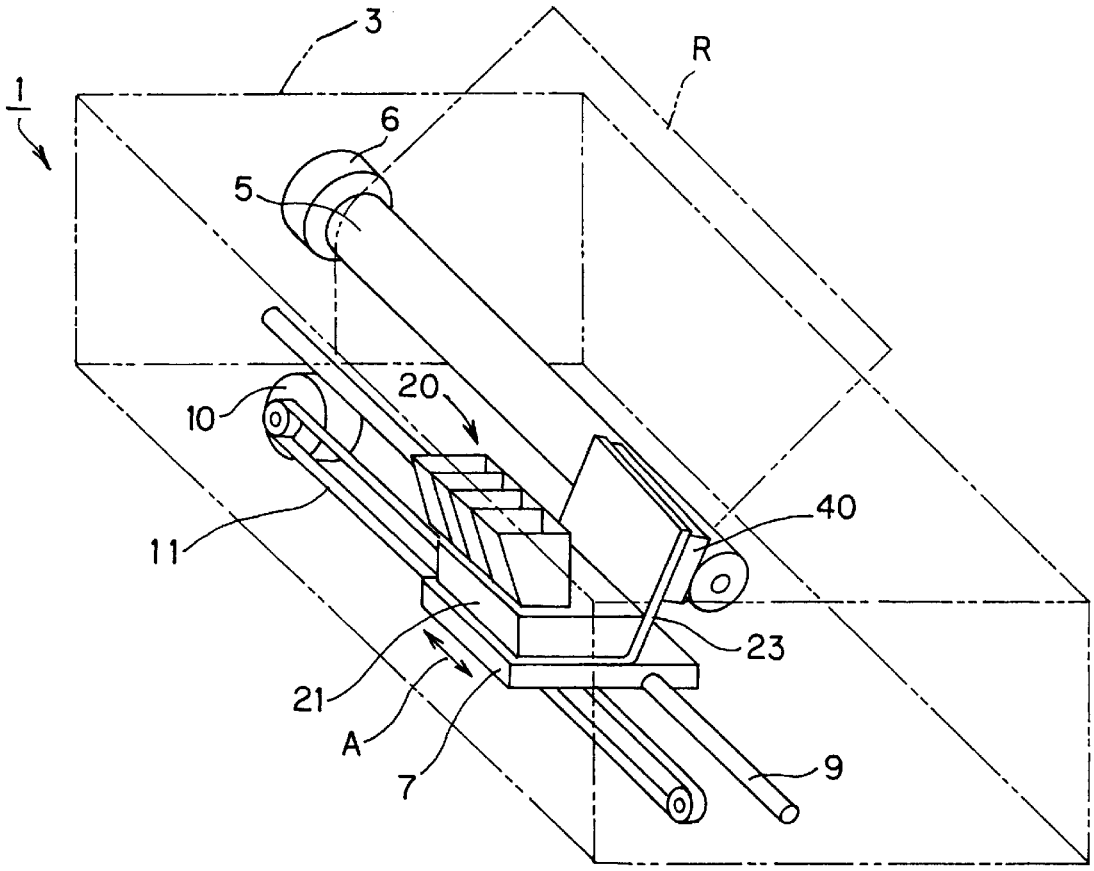
FIG. 1 is a diagram showing an internal construction of a printer of a first embodiment of the present invention.

FIG. 1 shows the internal construction of an inkjet printer 1, which is a first embodiment of the present invention. In FIG. 1, a conveyance roller 5 is installed in a body 3 of the printer 1. The conveyance roller 5 is driven by a conveyance motor 6 to convey a recording paper R in the upper direction of the printer 1. A head 20 is also installed in the body 3 and placed near the path of the recording paper R. The head 20 is supported by a carriage 7. The carriage 7 is slidably supported by a supporting member 9, so that the carriage 7 can move in the direction perpendicular to the direction of the conveyance of the recording paper R, together with the head 20. The supporting member 9 is fixed in the body 3. An arrow A in FIG. 1 represents the direction of the movement of the carriage 7. The carriage 7 is fixed on a timing belt 11. The timing belt 11 is driven by a carriage motor 10, so that the carriage 7 is reciprocatably moved in the direction A.

The head 20 has a plurality of ink tanks 21, a plurality of actuator 40 and a front panel 23. The number of the ink tanks 21 and the number of the actuator 40 respectively correspond to the number of color of ink. If inks of four color (for example: yellow, magenta, cyan and black) are used, these inks are separately stored in the respective ink tanks 21 for each color. The actuators 40 control the ink ejection for each color. The front panel 23 has a mechanism to carry the inks from the ink tanks 21 to the actuators 40.

Figure 2:
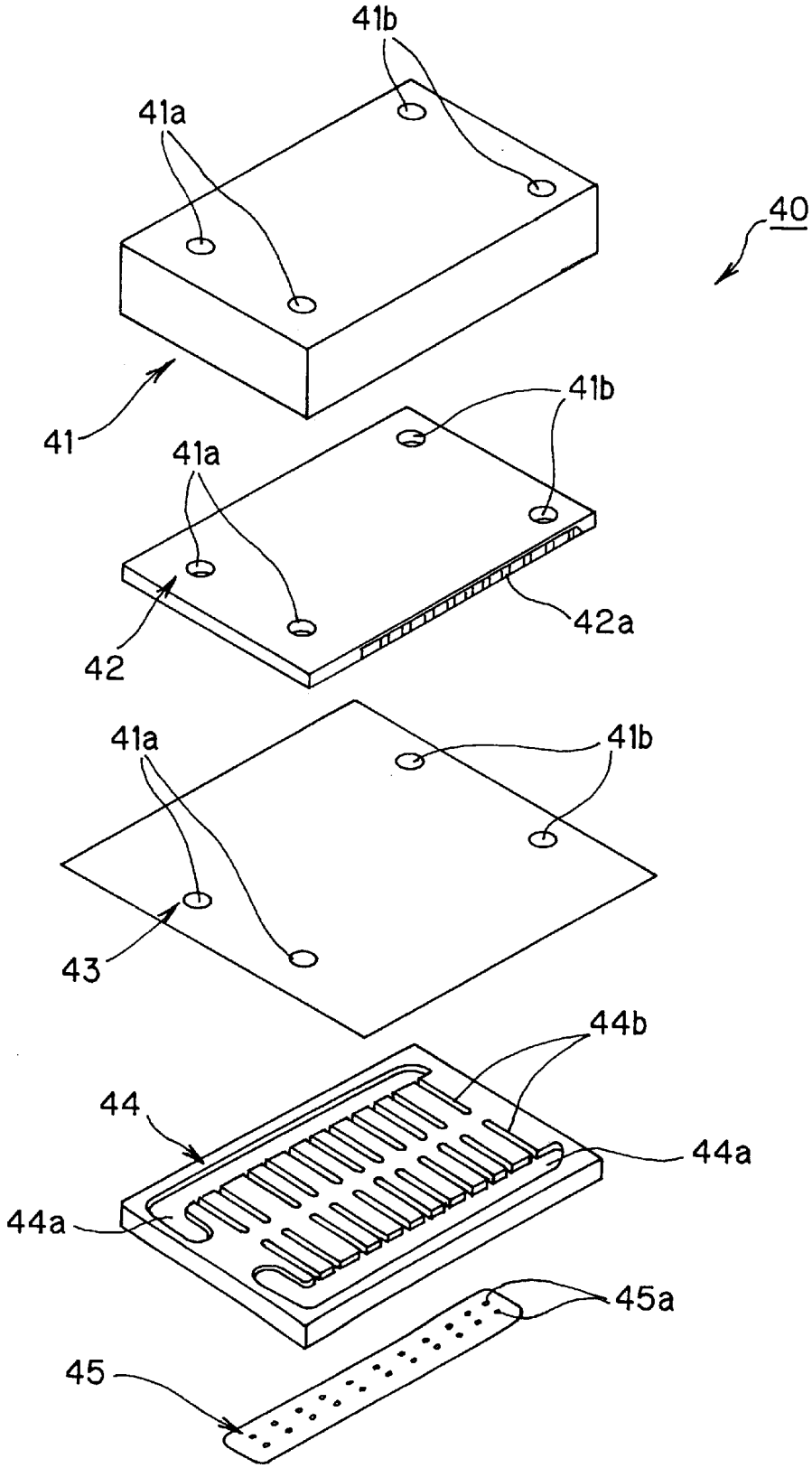
FIG. 2 is a diagram showing a construction of an actuator mounted on a head of the printer of the first embodiment.

As shown in FIG. 2, each actuator 40 has a base 41, a piezoelectric member 42, a diaphragm 43, a cavity plate 44 and a nozzle plate 45.

The nozzle plate 45 is a plate in which a large number of ink ejection holes 45*a* (for example, 128 ink ejection holes 45*a*) are arranged in two rows. The cavity plate 44 has a couple of L-shaped ink channels 44*a* and a plurality of ink chambers 44*b*. Each ink chamber 44*b* communicates with either of ink channels 44*a*, and extends in the perpendicular direction of the ink channels 44*a*. The number of the ink chamber 44*b* corresponds to the number of the ink ejection hole 45*a*. The ink chambers 44*b* communicate with the ink ejection holes 45*a*, respectively.

The piezoelectric member 42 has a large number of piezoelectric elements 42*a* (for example, 128 piezoelectric elements 42*a*). By the piezoelectric elements 42*a*, the volume of each ink chamber 44*b* can be shrunk and restored independently.

The diaphragm 43 functions as a partition wall between the piezoelectric member 42 and the cavity plate 44, and has elasticity. The base 41 is mounted on the upper portion of the actuator 40 to support the actuator 40.

In addition, two ink supply passages 41*a* and two ink return passages 41*b* are formed in each of the base 41, the piezoelectric member 42 and the diaphragm 43. The ink is supplied from the ink tank through the ink supply passages 41*a*, and returns to the ink tank through the ink return passages 41*b*. Thus, the ink circulates in the actuator 40 through these passages 41*a* and 41*b*.

Figure 3:
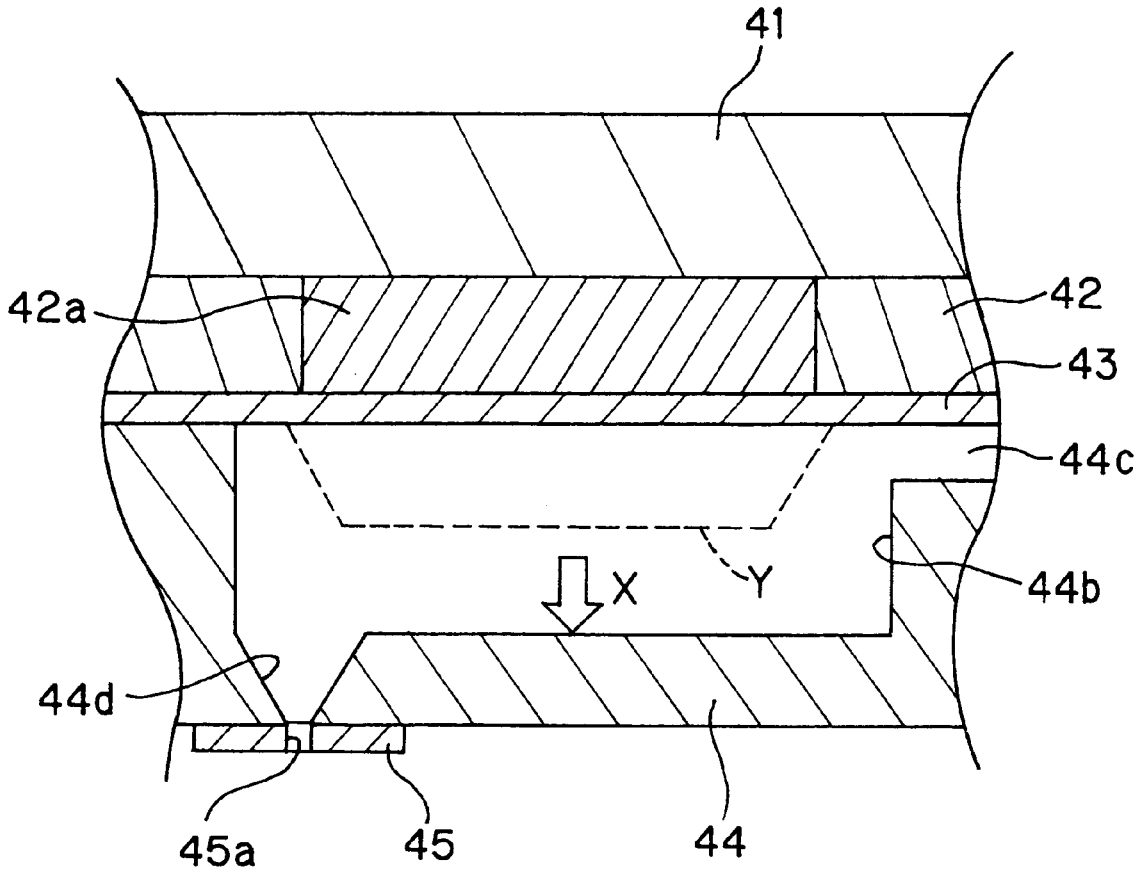
FIG. 3 is a diagram showing an internal construction of an ink chamber formed in the actuator of the first embodiment.

FIG. 3 is an enlarged and sectional view of one of the ink chambers 44*b* of the actuator 40. In FIG. 3, the ink chamber 44*b* is formed in the cavity plate 44, and communicates with the ink channel 44*a* through a communicating passage 44*c*. An orifice 44*d* is formed on the bottom side of the cavity plate 44 to connect the ink chamber 44*b* with the ink ejection hole 45*a*.

When a driving voltage of a high level is applied to the piezoelectric element 42*a*, the piezoelectric element 42*a* expands in the direction X shown in FIG. 3. Therefore, the volume of the ink chamber 44*b* is reduced, as shown by a dotted line Y in FIG. 3. When applying the driving voltage is stopped (i.e., the driving voltage is switched from the high level to a low level), the piezoelectric element 42*a* is restored, and then, the volume of the ink chamber 44*b* is restored.

Next, the ink ejecting operation of the actuator 40 of the head 20 will be described.

When the ink chambers 44*b* are reduced by applying the driving voltage of the high level to the piezoelectric elements 42*a*, the ink is supplied from the ink tank 21 to the respective ink channels 44*a* through the respective ink supply passages 41*a*. When the ink channels 44*a* are filled with the ink, the driving voltage is switched from the high level to the low level. Therefore, the ink chambers 44*b* are restored from their reduced condition, so that the volume of each ink chamber 44*b* increases, and a negative pressure occurs at each ink chamber 44*b*. Accordingly, the ink is moved from the ink channels 44*a* to the ink chambers 44*b* through the communicating passages 44*c*, and then, each ink chamber 44*b* is filled with the ink.

Next, the driving voltage of high level is applied to the piezoelectric elements 42*a*, and therefore, the volume of each ink chamber 44*b* is reduced again. Therefore, a positive pressure is applied to the ink in each ink chamber 44*b*. As a result, the ink is ejected from the ink chambers 44*b* to the outside of the actuator 40 through the orifices 44*d* and the ink ejection holes 45*a*.

Thus, in the first embodiment, the ink ejection is controlled by the change of the internal pressure in each ink chambers 44*b* of the actuator 40.

Next, a controller 30 for controlling the ink ejection of the printer 1 will be described with reference to FIG. 4. The controller 30 is connected with or installed in the printer 1.

Figure 4:
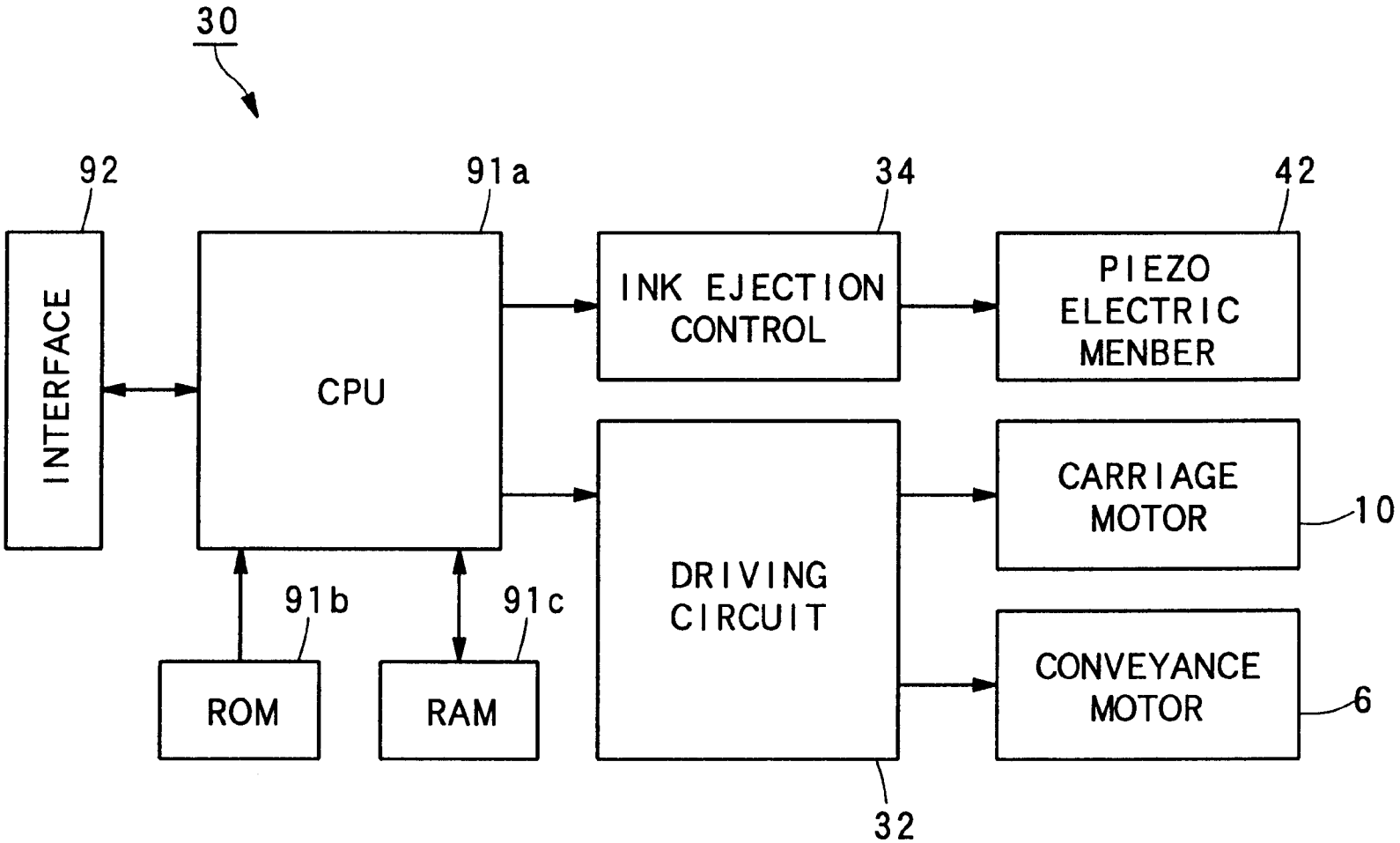
FIG. 4 is block diagram showing a controller of the printer of the first embodiment.

In FIG. 4, the controller 30 has: a CPU 91*a* for performing various calculations to control the printer 1; storage devices (ROM 91*b* and RAM 91*c*) for storing programs and parameters necessary for control of the printer 1; an interface 92 for controlling communications between the printer 1 and external personal computers (not shown); a driving circuit 32 for driving the carriage motor 10 and the conveyance motor 6 according to control signals supplied from the CPU 91*a*; and an ink ejection control portion 34 for controlling the distortion (expansion and restoring) of the piezoelectric elements 42*a* to control the ink ejection.

As the CPU 90*a*, an ASIC (Application Specific Integrated Circuit) may be used. The CPU 91*a* controls outputs of various signals including a discharging signal and a charging signal (which is described later), and counts the number of the ink chambers 44*b* that actually eject the ink in one ink ejection action.

Figure 5:
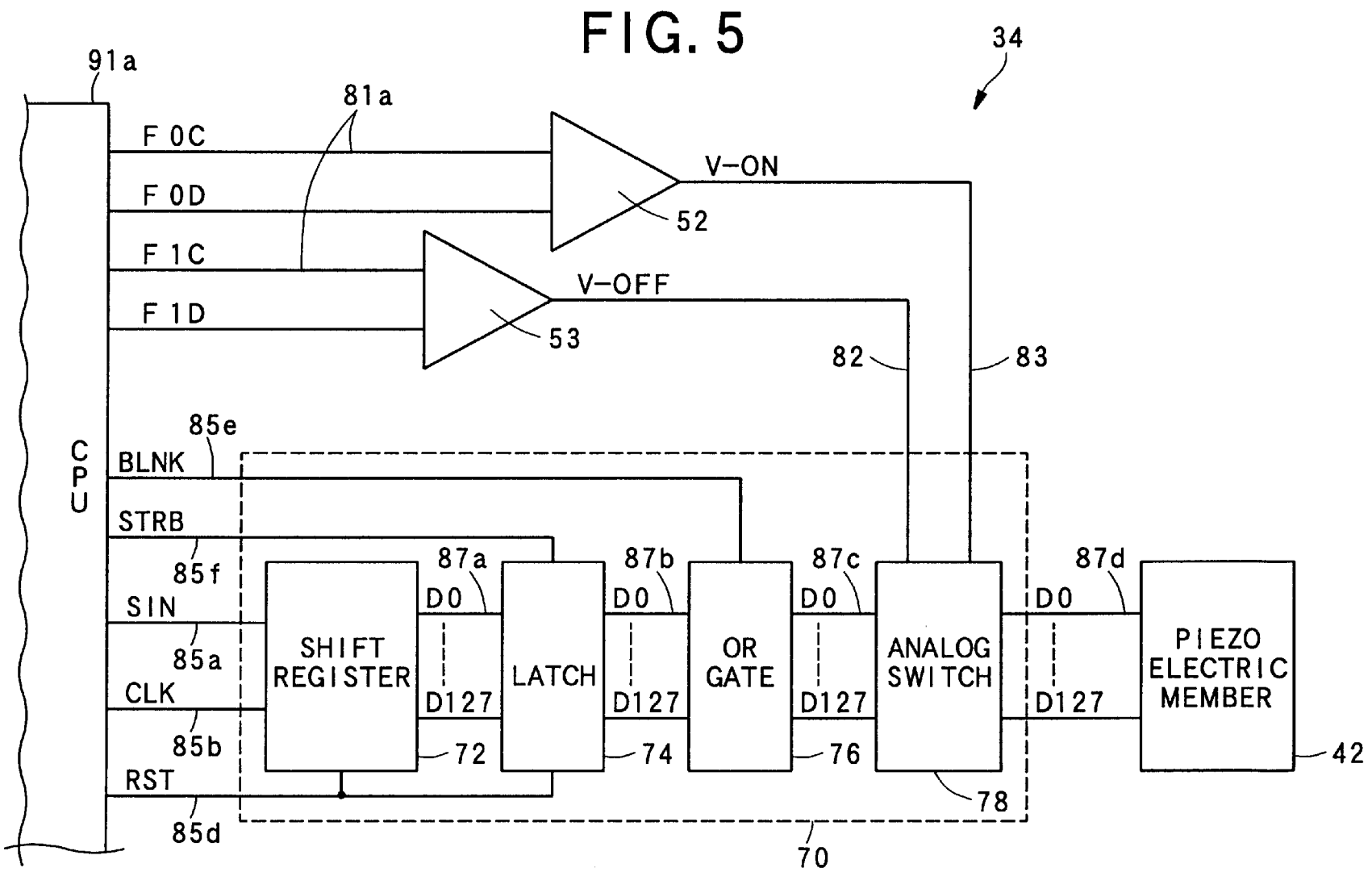
FIG. 5 is a block diagram showing an ink ejection control portion of the controller of the first embodiment.

As shown in FIG. 5, the ink ejection control portion 34 has: a first pulse amplifier 52 for supplying a first driving voltage V-ON to each piezoelectric element 42*a*; a second pulse amplifier 53 for supplying a second driving voltage V-OFF to each piezoelectric element 42*a*; and a driver IC 70 for determining whether or not the driving voltage V-ON or V-OFF is supplied to each piezoelectric element 42*a* via bus lines 87*d*.

The pulse amplifier 52 supplies the driving voltage V-ON to the piezoelectric elements 42*a* in order to perform the actual ink ejection. The driving voltage V-ON is used to control expansion and restoring of the piezoelectric elements 42*a* in order to actually eject the ink.

Figure 6A:
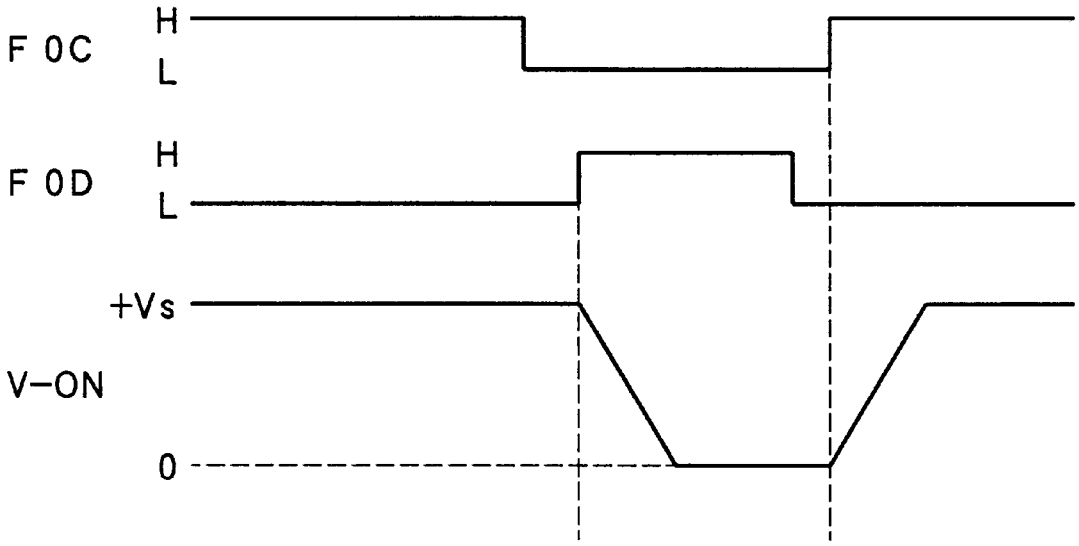
FIGS. 6A and 6B are diagrams each showing a charging signal, discharging signal and a driving voltage according to the first embodiment.

This driving voltage V-ON is shown in FIG. 6A. Like a pulse signal, the driving voltage V-ON is varied in the range of +Vs to 0. In FIG. 6A, the driving voltage V-ON is decreased from +Vs to 0 in a predetermined gradient, and thereafter, it is increased from 0 to +Vs in a predetermined gradient. These gradients are controlled by the pulse amplifier 52. In order to control these gradients of the driving voltage V-ON, the pulse amplifier 52 has a constant current circuit, a charging circuit and a discharging circuit. More concretely, a discharging signal F0D and a charging signal F0C are supplied to the pulse amplifier 52 from the CPU 91*a* via bus lines 81*a*, as shown in FIG. 5. As shown in FIG. 6A, when the level of the discharging signal F0D is switched to a high level, discharge is started in the discharging circuit of the pulse amplifier 52, so that the driving voltage V-ON is decreased from +Vs to 0. When the level of the charging signal F0C is switched to a high level, charge is started in the charging circuit of the pulse amplifier 52, so that the driving voltage V-ON is increased from 0 to +Vs.

On the other hand, the pulse amplifier 53 supplies the driving voltage V-OFF to the piezoelectric elements 42*a* in order to perform absorption of an unnecessary pressure wave, which will be described later. The driving voltage V-OFF is used to control expansion and restoring of the piezoelectric elements 42*a* in order to absorb the unnecessary pressure wave.

Figure 6B:
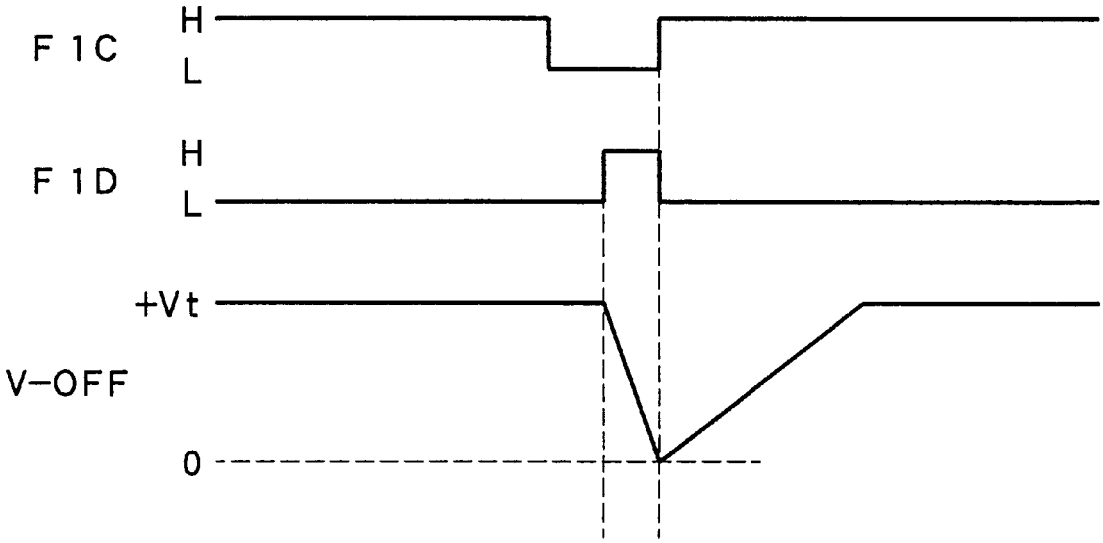

This driving voltage V-OFF is shown in FIG. 6B. Like a sawtooth signal, the driving voltage V-OFF is varied in the range of +Vt to 0. In FIG. 6B, the driving voltage V-OFF is decreased from +Vt to 0 in a predetermined gradient, and thereafter, it is increased from 0 to +Vt in a predetermined gradient. These gradients are controlled by the pulse amplifier 53. In order to control these gradients of the driving voltage V-OFF, the pulse amplifier 53 has a constant current circuit, a charging circuit and a discharging circuit. More concretely, a discharging signal F1D and a charging signal F1C are supplied to the pulse amplifier 53 from the CPU 91*a* via bus lines 81*a*, as shown in FIG. 5. As shown in FIG. 6B, when the level of the discharging signal F1D is switched to a high level, discharge is started in the discharging circuit of the pulse amplifier 53, so that the driving voltage V-OFF is decreased from +Vt to 0. When the level of the charging signal F1C is switched to a high level, charge is started in the charging circuit of the pulse amplifier 53, so that the driving voltage V-OFF is increased from 0 to +Vt.

The driver IC 70 has a shift register 72, a latch 73, an OR gate 76 and an analog switching device 78. The shift register 72 is connected with the CPU 91*a* via three bus lines 85*a*, 85*b* and 85*c*. The latch 73 is connected with the shift register 72 via 128 bus lines 87*a*. The OR gate 76 is connected with the latch 73 via 128 bus lines 87*b*. The analog switching device 78 is connected with the OR gate 76 via 128 bus lines 87*c*. The analog switch 78 is also connected with the piezoelectric member 42 via bus lines 87*d*. The 128 bus lines corresponds to the 128 piezoelectric elements 42*a*, respectively. The latch 74 and the OR gate 76 are further connected with the CPU 91*a*, respectively, via two different bus lines 85*e* and 85*f*.

The shift register 72 receives an SIN signal from the CPU 91*a* via the bus line 85*a*. The SIN signal includes digital serial data which is used to define the conditions (i.e., on or off) of 128 switching elements of the analog switching device 78. At the same time, the shift register 72 also receives a CLK signal from the CPU 91*a* via the bus line 85*b*. The CLK signal is a pulse signal (clock signal) having the frequency that corresponds to the data transfer rate of the digital serial data. The shift register 72 shifts the digital serial data included in the SIN signal according to the frequency of the CLK signal, in order to convert the digital serial data into 128 parallel signals D0–D127. These parallel signals D0–D127 are fed into the latch 74 via the bus line 87*a*.

The latch 74 stores the parallel signal D0–D127 fed from the shift register 72 via the bus lines 87*a*. Then, the latch 74 simultaneously feeds all of the stored parallel signal D0–D127 into the OR gate 76 via the bus lines 87*b* according to an STRB signal (strobe signal) fed from the CPU 91*a* via the bus line 85*f*.

The OR gate 76 usually sends the parallel signal D0–D127 to the analog switching device 78 via the bus lines 87*c*, when the parallel signal D0–D127 is sent from the latch 74 to the OR gate 76. However, when a BLNK signal is sent from the CPU 91*a* to the OR gate 76, the OR gate 76 outputs signals having high level voltage to all the bus lines 87*c*. That is, when the BLNK signal is sent from the CPU 91*a*, all the parallel signal D0–D127 are forcedly made high in level by the OR gate 76.

The analog switching device 78 is a device for alternatively sending either the driving voltage V-ON supplied from the pulse amplifier 52 via a bus line 83 or the driving voltage V-OFF supplied from the pulse amplifier 53 via a bus line 84 to the 128 piezoelectric elements 42*a*. The analog switching device 78 has 128 switching elements. These 128 switching elements are connected with the 128 piezoelectric elements, respectively, via the 128 bus lines 87*d*. In the analog switching device 78, either the driving voltage V-ON or V-OFF is supplied to the respective 128 switching elements. If the switching elements are the on condition, the driving voltage V-ON or V-OFF is supplied to the piezoelectric elements 42*a* through the switching elements. If the switching elements are the off condition, neither the driving voltage V-ON nor V-OFF is supplied to the piezoelectric elements 42*a*.

The 128 switching elements correspond to the 128 parallel signals D0–D127 supplied from the OR gate 76. The conditions (on or off) of the switching elements are independently controlled by the corresponding parallel signals D0–D127.

Figure 7:
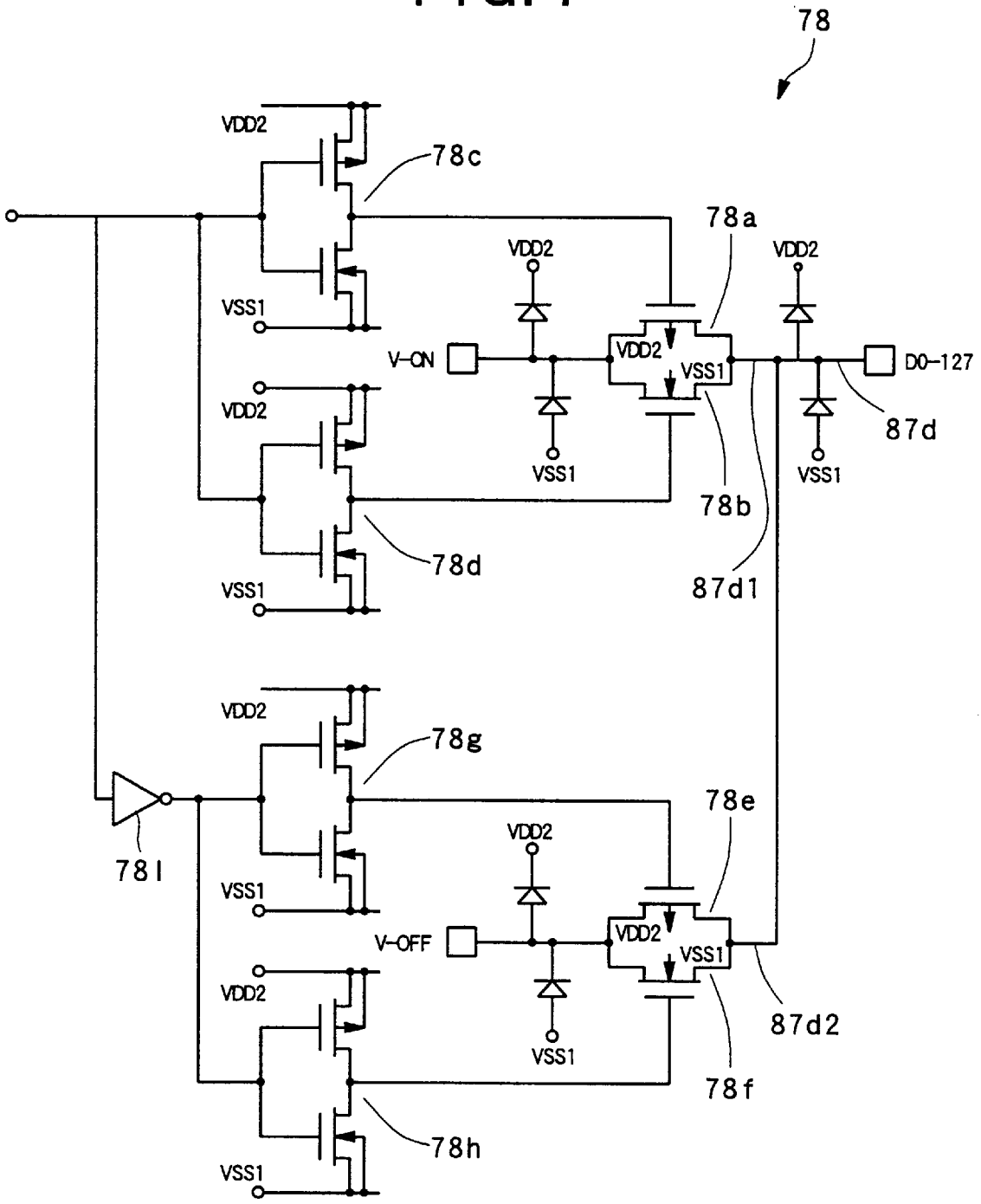
FIG. 7 is a diagram showing a construction of a switching element of an analog switching device of the first embodiment.

The equivalent circuit of one of the 128 switching elements is shown in FIG. 7. In addition, all the switching elements has the same construction. As shown in FIG. 7, the switching element has FETs (Field Effect Transistors). Concretely, the switching element has a first C-MOS transmission gate to be used for switching the driving voltage V-ON and a second C-MOS transmission gate to be used for switching the driving voltage V-OFF. The first C-MOS transmission gate consists of a P-MOSFET 78*a* and an N-MOSFET 78*b*, which are connected with each other in parallel. The second C-MOS transmission gate consists of a P-MOSFET78*e* and an N-MOSFET 78*f*, which are connected with each other in parallel. The corresponding one of the parallel signal D0–D127 is input to the first C-MOS transmission gate through a first input portion including C-MOSFETs 78*c* and 78*d*. This parallel signal is also input to the second C-MOS transmission gate through a second input portion including C-MOSFETs 78*g* and 78*h*.

If the corresponding parallel signal output from the OR gate 76 is the high level, both FETs 78*a* and 78*b* become off (i.e., the source terminal and the drain terminal are not connected). As a result, the driving voltage V-ON is not supplied to the bus line 87*d*1. At this time, both FETs 78*e* and 78*f* become on (i.e., the source terminal and the drain terminal are connected), because the parallel signal supplied to the second C-MOS transmission gate is inverted by the inverter 78*i*. As a result, the driving voltage V-OFF may be supplied to the bus line 87*d*2.

On the other hand, if the corresponding parallel signal output from the OR gate 76 is the low level, both FETs 78*a* and 78*b* become on (i.e., the source terminal and the drain terminal are connected). As a result, the driving voltage V-ON may be supplied to the bus line 87*d*1. At this time, both FETs 78*e* and 78*f* become off (i.e., the source terminal and the drain terminal are not connected). As a result, the driving voltage V-OFF is not supplied to the bus line 87*d*2.

In this manner, the switching elements of the analog switching device 78 operate according to the parallel signal D0–D127. For example, if the parallel signal D0 is the high level, the switching element corresponding to the parallel signal D0 allows the driving voltage V-OFF to be supplied to the bus line 87*d*. If the parallel signal D1 is the low level, the switching element corresponding to the parallel signal D1 allows the driving voltage V-ON to be supplied to the bus line 87*d*.

Figure 8:
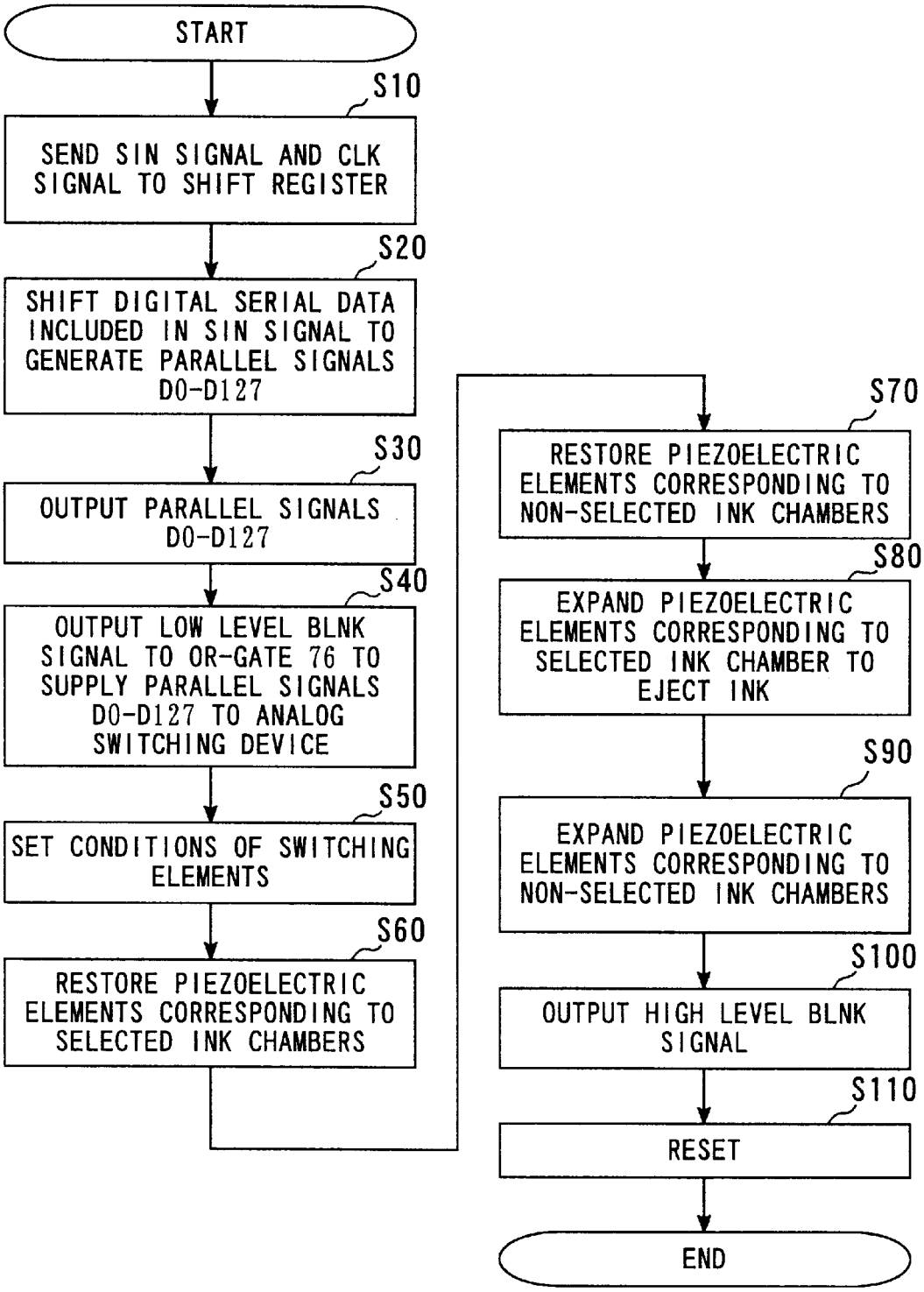
FIG. 8 is a flowchart showing an operation of a CPU in the controller.
Figure 9:
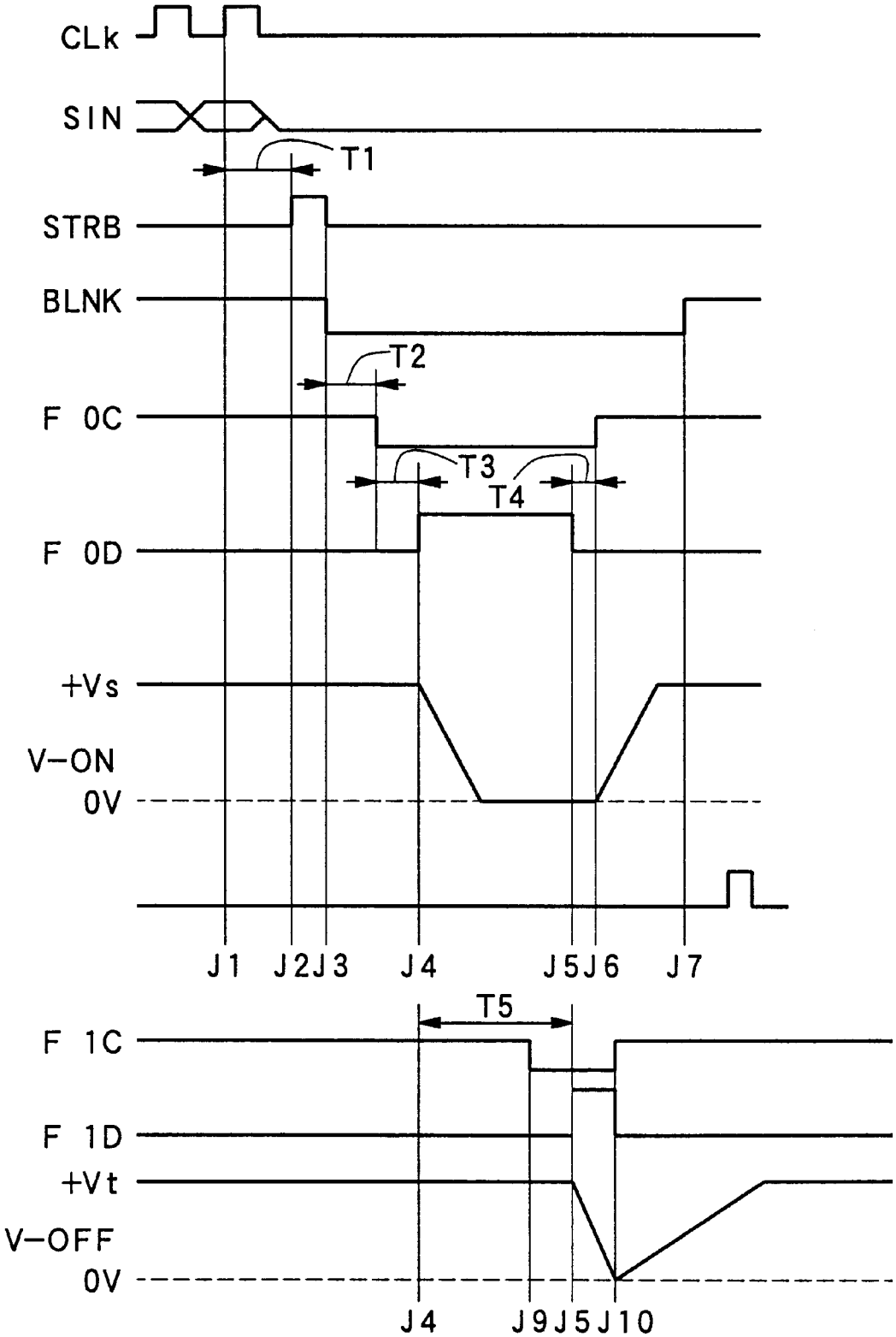
FIG. 9 is a diagram showing signals used for an ink ejecting operation according to the first embodiment.

Next, an operation of the CPU 91*a* will be described with reference to FIGS. 8 and 9. The CPU 91*a* performs the ink ejection control process shown in FIG. 8, in order to eject the ink from the actuator 40.

At first, the CPU 91*a* performs an initializing operation. Namely, the CPU 91*a* supplies the driving voltage V-ON having the voltage of +Vs to all the piezoelectric elements 42*a* under the control of the BLNK signal and the charging signal F0C. Therefore, all of the piezoelectric elements 42*a* are expanded. In addition, it is assumed that the ink channels 44*a* of the cavity plate 44 are filled with the ink at this time.

Firstly, the CPU 91*a* sends the SIN signal and CLK signal to the shift register 72 (step 10). For example, if the printer 1 uses bitmap data, a square or rectangular cell matrix consisting of a plurality of cells is formed on a memory space in the RAM. In addition, the number of cells is determined depending on the resolution. Then, image data to be printed is placed onto the cell matrix, and color information (yellow, magenta, cyan, black or blank) is given to each cell. Then, the CPU 91*a* generates the SIN signal with respect to a cell unit consisting of 128 cells, and sends this to the bus line 85*a*. In addition, the head 20 ejects the ink for each cell unit. That is, the ink ejection is performed with respect to one cell unit consisting of 128 cells in one ink ejecting action. The CLK signal is synchronized with the SIN signal. The CLK signal has 128 pulses in each time unit thereof.

Next, the CPU 91*a* controls the shift register 72 in such a way that the shift register 72 shifts the digital serial data included in the SIN signal according to the CLK signal and outputs the digital serial data as the parallel signal D0–D127 from the parallel output terminals of the shift register 72 to the latch 74 (step 20).

Next, the CPU 91*a* controls the latch 74 in such a way that the latch 74 outputs the parallel signals D0–D127 simultaneously (step 30). Concretely, the CPU 91*a* outputs the STRB signal to the latch 74 via the bus line 85*f* at the time J2 that the time period T1 has just passed after the last pulse included in the time unit of the CLK signal rose (time J1 in FIG. 9). As a result, all the parallel signals D0–D127 stored in the latch 74 are simultaneously output from the latch 74 to the bus line 87*b* at the time J2 in FIG. 9.

Next, at step 40, the CPU 91*a* outputs the BLNK signal of the low level to the OR gate 76, when the STRB signal becomes the low level (time J3 in FIG. 9), so that the parallel signals D0–D127 can be directly supplied to the analog switching device 78 through the OR gate 76.

When the parallel signals D0–D127 are supplied to the analog switching device 78, the conditions (on or off) of the switching elements are set on the basis of whether the respective parallel signals D0–D127 are the high level or low level (step 50). In addition, the level (high or low) of the individual parallel signal is determined by the CPU 91*a*, depending on whether or not the ink is ejected for each cell, and the ink ejection for each cell is determined depending on the image data placed on the cell unit. If the parallel signal is the low level, the condition of the corresponding switching element is set so as to allow the driving voltage V-ON to be supplied to the corresponding piezoelectric element 42*a*. This means that the ink chamber 44*b* corresponding to this piezoelectric element 42*a* is selected as the ink chamber 44*b* that actually ejects the ink in this ink ejecting action. Hereinafter, the ink chamber 44*b* that actually ejects the ink is referred to as a "selected ink chamber 44*b*". On the other hand, if the parallel signal is the high level, the condition of the corresponding switching element is set so as to allow the driving voltage V-OFF to be supplied to the corresponding piezoelectric element 42*a*. This means that the ink chamber 44*b* corresponding to this piezoelectric element 42*a* is selected as the ink chamber 44*b* that does not eject the ink in this ink ejecting action. Hereinafter, this ink chamber 44*b* that does not eject the ink is referred to as a "non-selected ink chamber 44*b*.

Next, the CPU 91*a* outputs the charging signal F0C and the discharging signal F0D. Then, the CPU 91*a* switches the level of the discharging signal F0D from the low level to the high level at the time J4, in order to restore the piezoelectric elements 42*a* corresponding to the selected ink chambers 44*b* (step 60). In response to this, the driving voltage V-ON is varied from +Vs to 0, as shown in FIG. 9, so that the piezoelectric elements 42*a* corresponding to the selected ink chambers 44*b* are restored. Therefore, the volume of each selected ink chamber 44*b* is expanded (restored), and the ink is moves into the selected ink chambers 44*b* from the ink channels 44*a*. In addition, the driving voltage is maintained +Vt at this stage.

Next, the CPU 91*a* outputs the charging signal F1C and the discharging signal F1D. Then, the CPU 91*a* switches the level of the discharging signal F1D the low level to the high level at the time J5 that the time period T5 has just passed from the time J4, in order to restore the piezoelectric elements 42*a* corresponding to the non-selected ink chambers 44*b* (step 70). In response to this, the driving voltage V-OFF is varied from +Vt to 0, so that the piezoelectric elements 42*a* corresponding to the non-selected ink chambers 44*b* are restored. Therefore, the volume of each non-selected ink chamber 44*b* is gradually expanded (restored).

Next, the CPU 91*a* switches the level of the charging signal F0C from the low level to the high level at the time J6, in order to expand again the piezoelectric elements 42*a* corresponding to the selected ink chamber 44*b* (step 80). In response to this, the driving voltage V-ON is varied from 0 to +Vs, so that the piezoelectric elements 42*a* corresponding to the selected ink chambers 44*b* are expanded. Therefore, the positive pressure is applied to the selected ink chambers 44*b*, and the ink is ejected from the selected ink chambers 44*b* to the outside through the corresponding ink ejection holes 45*a*.

When the positive pressure is applied to the selected ink chambers 44*b* in order to eject the ink from the selected ink chambers 44*b*, a pressure wave of ink occurs in the selected ink chambers 44*b*. This pressure wave is propagated through the ink existing in the ink channels 44*a*, and then reaches the non-selected ink chambers 44*b*. At this time, the volume of each non-selected ink chamber 44*b* has been expanded by the operation of the previous step 70. Therefore, this pressure wave is absorbed by the expansion of the non-selected ink chambers 44*b*. As a result, the pressure wave is restrained.

Next, the CPU 91*a* switches the level of the charging signal F1C from the low level to the high level at the time J10 (step 90). In response to this, the driving voltage V-OFF is gradually varied from 0 to +Vt. Therefore, the piezoelectric elements 42*a* corresponding to the non-selected ink chambers 44*b* are gradually expanded again. At this time, the driving voltage V-OFF is slowly varied, so that the expansion of these piezoelectric elements 42*a* is slow. Accordingly, the ink stored in the non-selected ink chambers 44*b* is not ejected.

Next, the CPU 91*a* outputs the BLNK signal of the high level at the time J7 (step 100), after the driving voltage V-ON of +Vs is sufficiently supplied to each piezoelectric element 42*a*. Therefore, the driving voltage V-ON of +Vs is applied to all the piezoelectric elements 42*a*.

Next, the CPU 91*a* outputs the RST signal in order to reset the shift register 72 and the latch 74 (step 110). Thus, the ink ejecting control process with respect to one cell unit ends.

Figure 10:
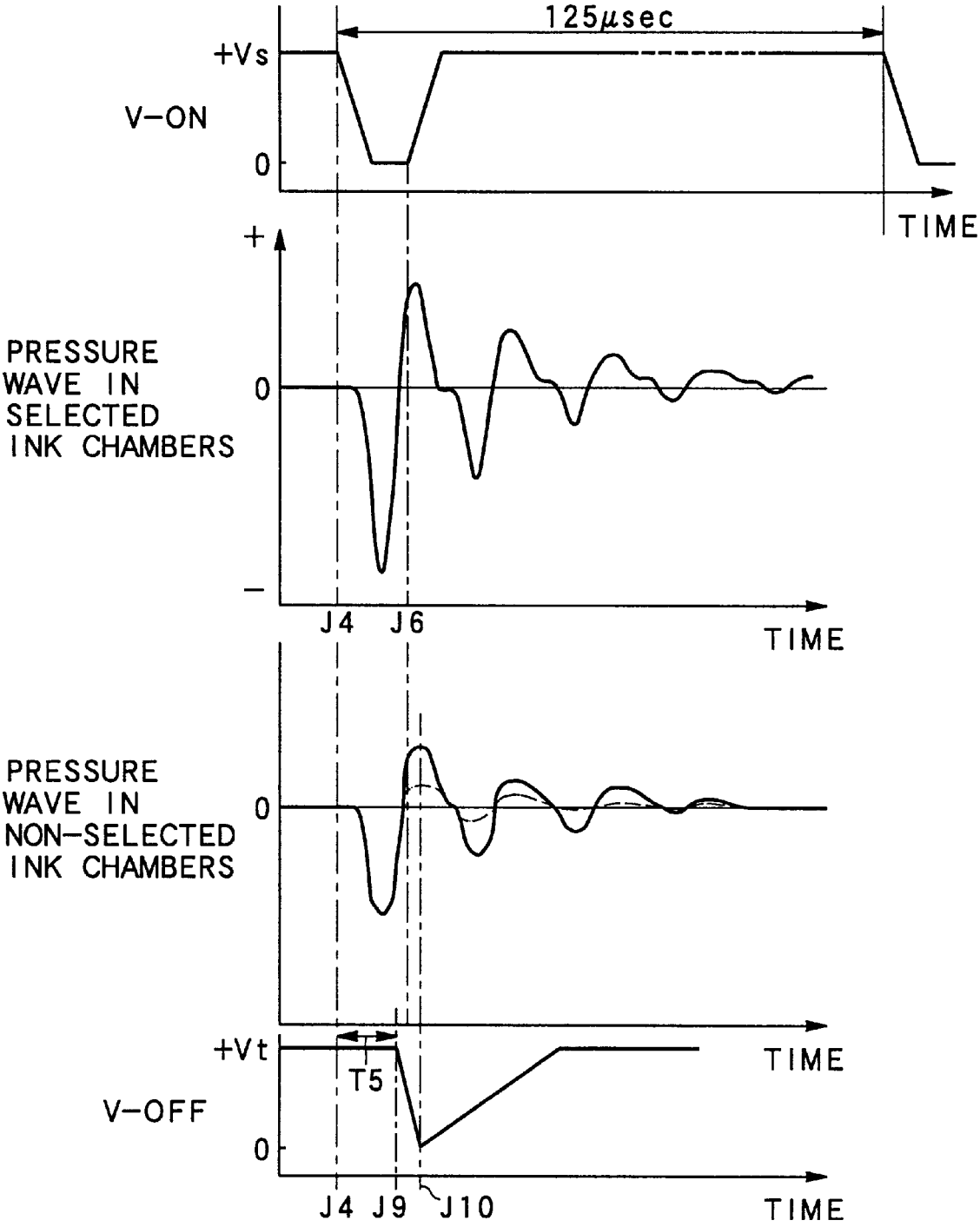
FIG. 10 is a diagram showing the driving signals and pressure waves in the first embodiment.
Figure 11:
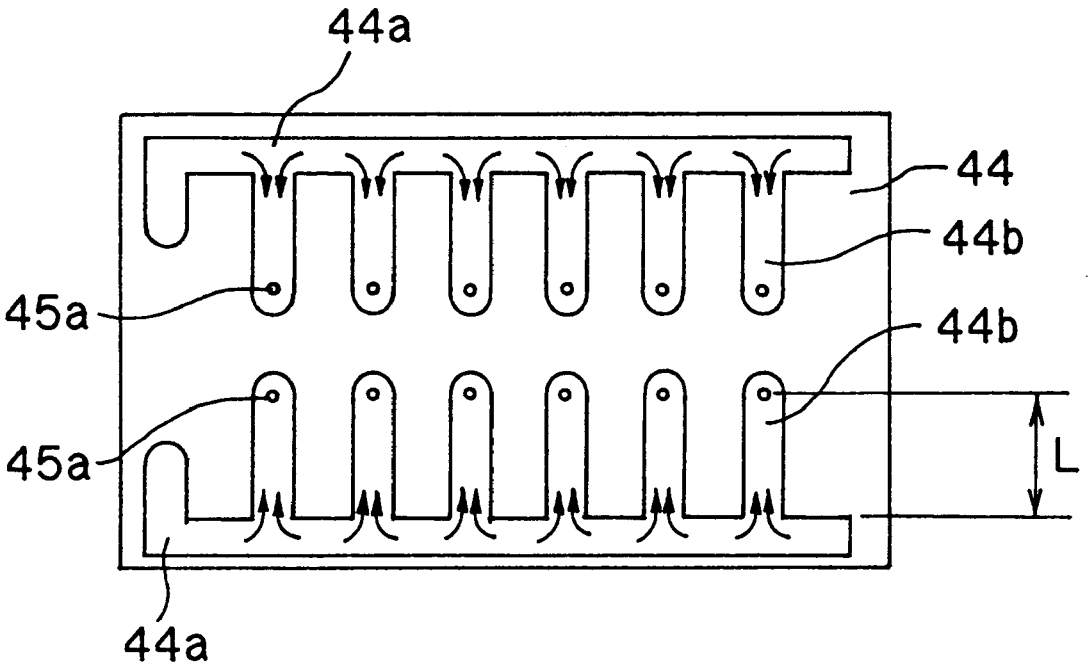
FIG. 11 is a diagram showing ink chambers of the printer of the first embodiment.

Referring to FIGS. 10 and 11, the absorption of the pressure wave will be now described in detail.

In FIG. 10, in order to move the ink from the ink channels 44*a* into the selected ink chambers 44*b*, the CPU 91*a* changes the driving voltage V-ON from +Vs to 0 at the time J4. In response to this, the piezoelectric elements 42*a* corresponding to the selected ink chambers 44*b* are restored, and then, the volume of each selected ink chamber 44*b* is expanded. Therefore, the internal pressure of each selected ink chamber 44*b* is decreased, and the ink is moved from the ink channels 44*a* into the selected ink chambers 44*b*. When the ink has been moved into the selected ink chambers 44*b*, the internal pressure of each selected ink chamber 44*b* is excessively increased. Therefore, the ink partly returns from the selected ink chambers 44*b* to the ink channels 44*a*, because the liquid ink moves to maintain its pressure uniformly. Thus, the ink is repeatedly moved between the ink channels 44*a* and the selected ink chambers 44*b*, so that the pressure wave PW1 occurs in the ink, as shown in FIG. 10.

As shown in FIG. 10, the amplitude of the pressure wave PW1 becomes its maximum at the time J6 (or immediately before the time J6). At this time, the CPU 91*a* changes the driving voltage V-ON from 0 to +Vs. Therefore, the piezoelectric elements 42*a* corresponding to the selected ink chambers 44*b* are expanded, and the positive pressure is applied to the ink in the selected ink chambers 44*b*. As a result, the ink is ejected from the selected ink chamber 44*b* to the outside in its maximum speed.

At this time, the pressure wave PW1 is propagated through the ink existing in the ink channels 44*a*, and reaches the non-selected ink chambers 44*b*. This propagated pressure wave is shown in FIG. 10 as a pressure wave PW2. If the pressure wave PW2 is large, there is a possibility that the ink stored in the non-selected ink chambers 44*b* leaks to the outside through the corresponding ink ejecting holes 45*a*. Such leakage of ink causes some problems as follows. (i) The leakage of the ink can disturb a shape of a meniscus of the ink in the ink ejecting holes 45*a*. The disturbance of the meniscus causes undesirable changes of the ejecting direction of the ink, so that accuracy of the ink ejection is degraded. (ii) If the ink leaks, the movement of the meniscus cannot be controlled correctly. This causes impossibility of the ink ejection. (iii) If the large amount of ink is adhered on the nozzle plate 45 due to the leakage of the ink, the ink touches the surface of the recording paper, so that the recording paper becomes dirty.

In order to prevent such problems, the printer 1 of the first embodiment of the present invention has means for removing the influence of the pressure wave. The CPU 91*a* changes the driving voltage V-OFF from +Vt to 0 when the pressure wave PW2 increases, namely, the time J5. In response to this, the piezoelectric elements 42*a* corresponding to the non-selected ink chambers 44*b* are restored, and the volume of each non-selected ink chamber 44*b* is expanded. Therefore, the pressure wave PW2 is absorbed by the expansion of each non-selected ink chamber 44*b*. Accordingly, the influence of the pressure wave PW2 can be restrained, and leakage of the ink can be prevented.

More specifically, the driving voltage V-OFF starts to be varied from +Vt toward 0 at the time J5, and reaches 0 at the time J10. The time J10 is equal to the time that the amplitude of the pressure wave PW2 reaches its peak. The time that the amplitude of the pressure wave PW2 reaches its peak, i.e., the time J10, can be calculated by using the propagation velocity of the pressure wave and the propagated distance of the pressure wave. The propagation velocity PV of the pressure wave is approximately equal to the sound velocity. The propagated distance of the pressure wave is approximately equal to the length L of the ink chamber 44*b*, as shown in FIG. 11. The cycle C of the pressure wave is given as:

$$C=L/PV. \quad (1)$$

As shown in FIG. 10, the time that the amplitude of the pressure wave PW2 reaches its peak matches with the time that the time period equal to the ¾ cycle C has just passed from the time J4. In such a manner, the time J10 can be calculated. Further, the time that the time period T5 has just passed from the time J4 is set as the time J5. The driving voltage V-OFF begins to be decreased from +Vt to 0 at the time J5, and then reaches 0 at the time J10, and then, it is increased from 0 to +Vt at time J10. Such a change of the driving voltage V-OFF is controlled by the ASIC, the CPU 91*a*.

In such a manner, the pressure wave can be absorbed. As a result, the amplitude of the pressure wave PW2 is decreased, as shown by the dotted line PW3 in FIG. 10. Hence, the aforementioned problems (i), (ii), and (iii) can be prevented.

Furthermore, as compared with the gradient (velocity) of the increase of the driving voltage V-ON (from 0 to +Vs), the gradient of the increase of the driving voltage V-OFF (from 0 to +Vt) is small (not steep) in FIG. 10. Therefore, the volume of each non-selected ink chambers 44*b* is slowly reduced, so that the ink stored in the non-selected ink chamber 44*b* is not ejected to the outside. For example, in case that the cycle of the change in the driving voltage V-ON is 125 μsec, and the resolution is 300 dpi, the gradient of increase of the driving voltage V-OFF may be controlled in such a way that the driving voltage V-OFF is increased from 0 to +Vt during more than 10 μsec.

In addition, the gradient of the driving voltage V-OFF may be adjusted depending on resistance values in the pulse amplifiers 53. The gradient of the driving voltage V-ON may be adjusted depending on resistance values in the pulse amplifiers 52.

According to the printer 1 of the first embodiment of the present invention, it is possible to prevent that the ink stored in the non-selected ink chambers 44*b* leaks to the outside due to the pressure wave of the ink, and to improve the accuracy of the ink ejection.

II. Second Embodiment

Figure 12:
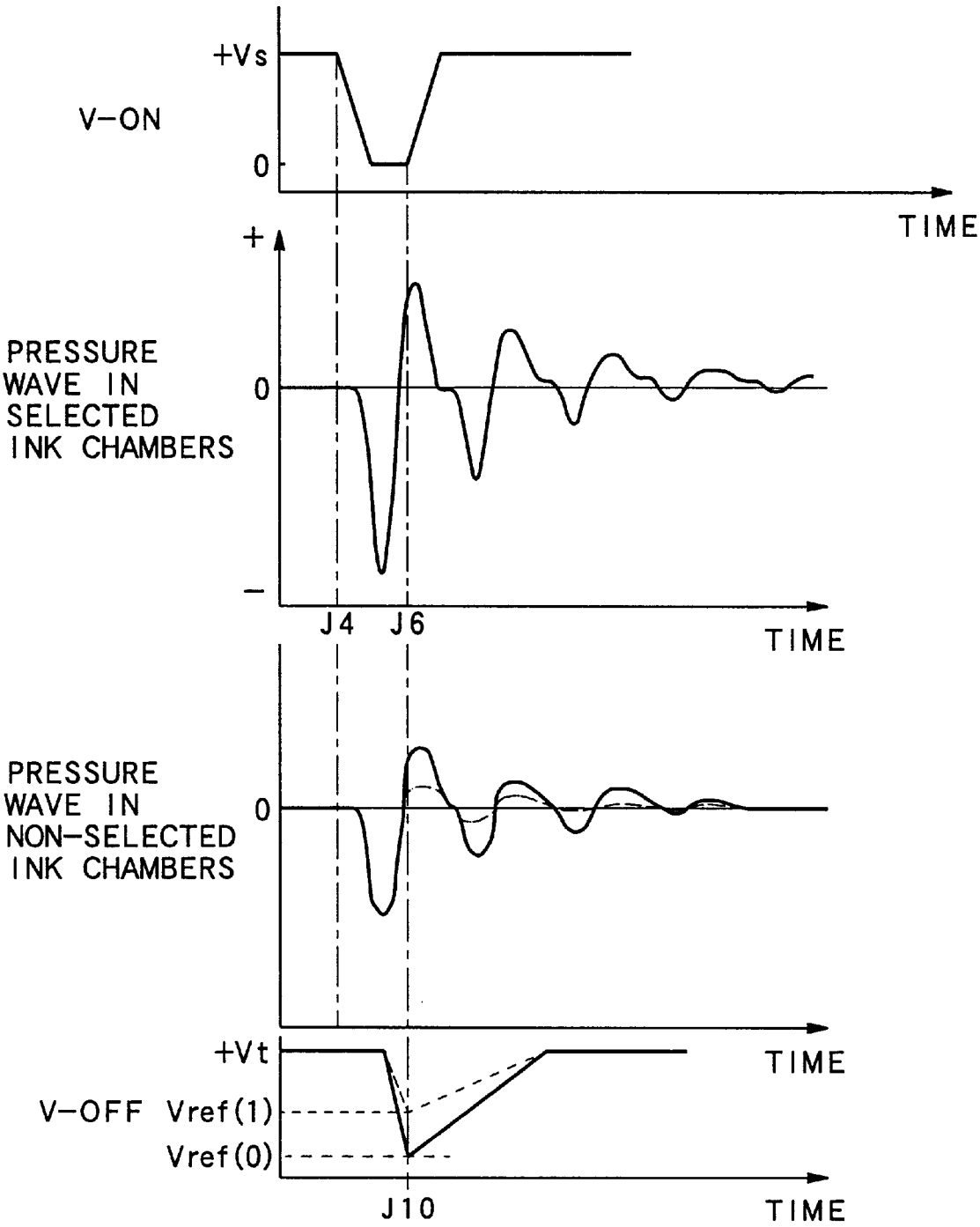
FIG. 12 is a diagram showing driving signals and pressure waves in a second embodiment of the present invention.
Figure 13:
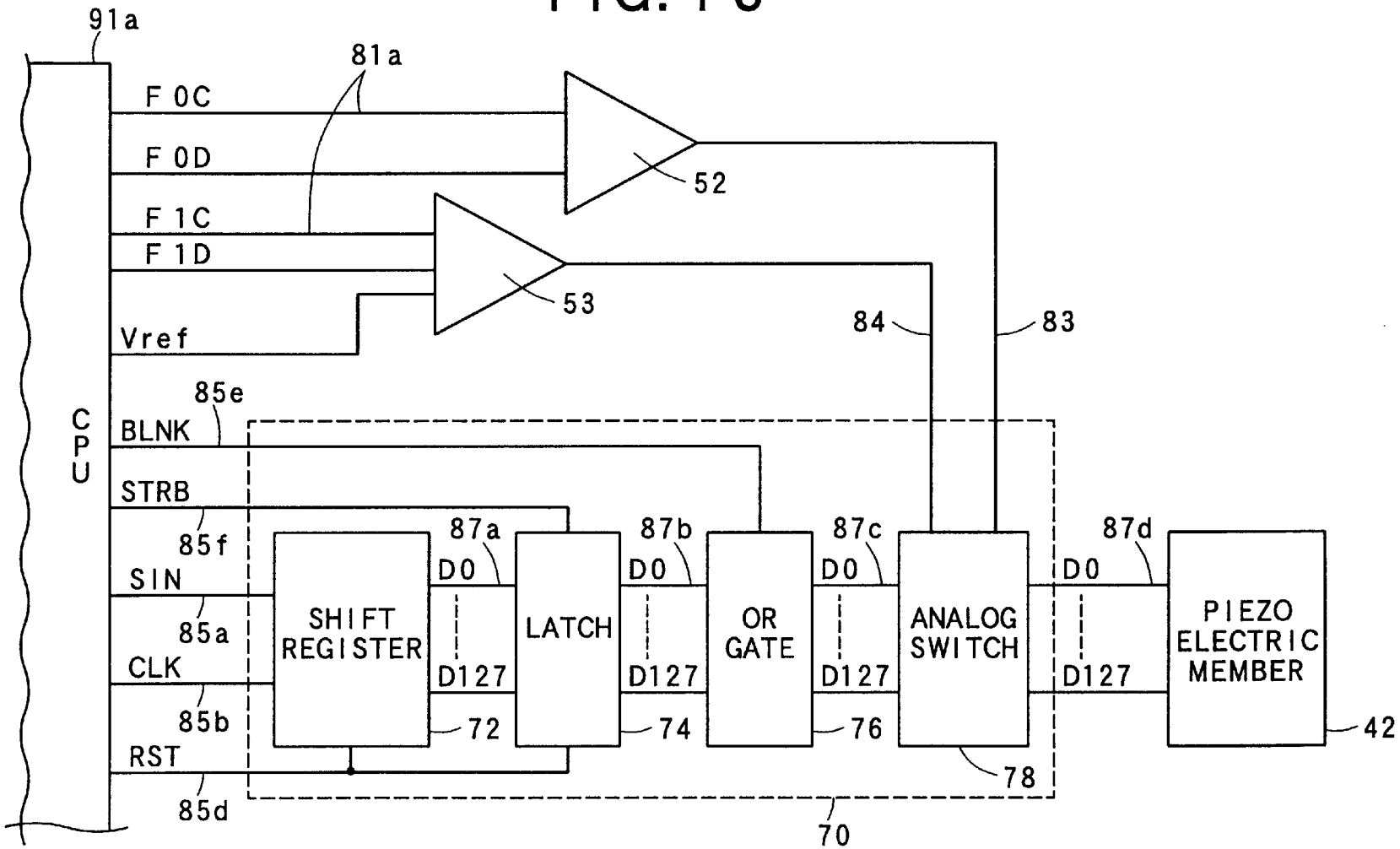
FIG. 13 is a block diagram showing an ink ejection control portion of the second embodiment.

Next, the second embodiment of the present invention will be described with reference to FIGS. 12 and 13. In FIG. 13, the same constructional elements as those in FIG. 5 carry the same reference number and their explanations are omitted. The feature of the second embodiment is that degrees of the distortion of the piezoelectric elements corresponding to the non-selected ink chambers 44*b* are determined depending on the number of the selected ink chambers 44*b* or depending on the positional relationship between the selected ink chambers 44*b* and the non-selected ink chambers 44*b*.

As shown in FIG. 13, the pulse amplifier 153 is connected with the CPU 91*a* through a reference voltage supply line 185. The reference voltage Vref is supplied from the CPU 91*a* to the pulse amplifier 153 via the reference voltage supply line 185. The pulse amplifier 153 controls the wave form of the driving voltage V-OFF on the basis of the reference voltage Vref. When the number of the selected ink chambers 44*b* is large, the reference voltage Vref is low. When the number of the selected ink chambers 44*b* is small, the reference voltage Vref is high. Except for this point, the construction of the pulse amplifier 153 is the same as that of the pulse amplifier 53 of the first embodiment.

For example, when the number of the selected ink chambers 44*b* is more than half of the number of all the ink chambers 44*b* (128), the reference voltage Vref is set as Vref(0). Therefore, like the first embodiment, the driving voltage V-OFF is varied from +Vt to Vref(0), as shown in FIG. 12, so that the expansion of the volume of each non-selected ink chambers 44*b* is relatively large. Thus, if the number of the selected ink chambers 44*b* is large, leakage of the ink can be prevented.

On the other hand, when the number of the selected ink chambers 44*b* is less than half of the number of all the ink chambers 44*b*, the reference voltage Vref is set as Vref(1). Therefore, the driving voltage V-OFF is varied from +Vt to Vref(1), so that the expansion of the volume of each non-selected ink chambers 44*b* is relatively small.

In the second embodiment, the +Vt is 30, the Vref(1) is 10, and the Vref(0) is 0, for example.

According to the second embodiment, if the number of the selected ink chambers 44*b* is small, the gradient of increase of the driving signal V-OFF (from Vref(1) to +Vt) can be smaller than that of increase of the driving signal V-OFF of the first embodiment (from 0 to +Vt). Therefore, leakage of the ink can be prevented more effectively. Furthermore, if the gradient of increase of the driving signal V-OFF (from Vref(1) to +Vt) is similar to that of increase of the driving signal V-OFF of the first embodiment (from 0 to +Vt), the time period during which the driving signal V-OFF increases from Vref(1) to +Vt can be shortened. Thus, it is possible to make the resolution high, or to make the cycle of the change of the driving voltage V-ON short, while preventing the leakage of the ink.

As mentioned above, the reference voltage Vref is changed depending on the number of the selected ink chambers 44*b*. The present invention is not limited to this. The reference voltage Vref may be changed depending on the positional relationship between the selected ink chambers 44*b* and the non-selected ink chambers 44*b*. For example, when the selected ink chambers 44*b* and the non-selected ink chambers 44*b* are alternately located, the influence of the pressure wave is large. In this case, the reference voltage Vref is set as a relatively high voltage. When the selected ink chambers 44*b* are located on one side (the upper side in FIG. 11) and the non-selected ink chambers 44*b* are located on the other side (the lower side in FIG. 11), the influence of the pressure wave is small, although the number of the selected ink chambers 44*b* is the same as that in the former case.

Figure 14:
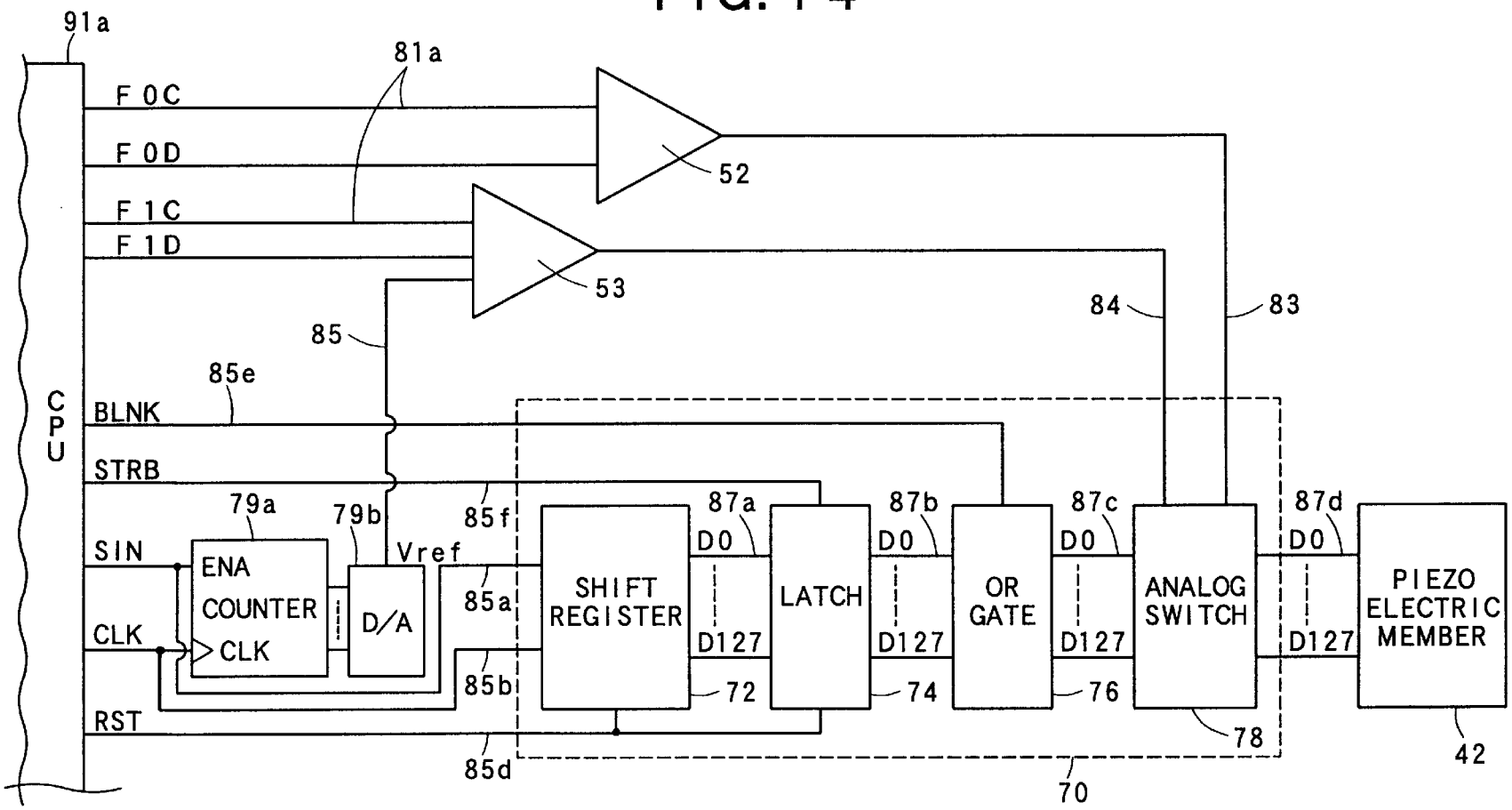
FIG. 14 is a block diagram showing another ink ejection control portion according to another embodiment of the present invention.

Moreover, although two reference voltages Vref(0) and Vref(1) are used in the second embodiment, more than three reference voltages may be used. For example, the CPU 91*a* can detect the number of the selected ink chambers 44*b* on the basis of the image data placed on the cell unit, and then, the CPU 91*a* can set the reference voltage Vref according to this detection. Moreover, the number of the selected ink chambers 44*b* can be detected by using a counter which is connected between the CPU 91*a* and the shift register 72, and which counts the digital serial data included in the SIN signal. Namely, as shown in FIG. 14, a counter 79*a* and a D/A converter 79*b* are connected between the CPU 91*a* and the shift register 72. The counter 79*a* counts the digital serial data included in the SIN signal, and recognizes the number of the selected ink chambers 44*b*. The digital value representing the number of the selected ink chambers 44*b* is fed into the D/A converter 79*b*. The D/A converter 79*b* converts the received digital value into the analog reference voltage Vref. This reference voltage Vref is supplied to the pulse amplifier 53. Such a construction is possible.

Moreover, the number of the selected ink chambers located only in the vicinity of each of the non-selected ink chambers may be counted, and the resultant number may be used for the control of the reference voltage Vref. The non-selected ink chamber located in the vicinity of the selected ink chamber is easy to be affected by the pressure wave occurring from this selected ink chamber. Therefore, if the reference voltage Vre is determined according to the number of the selected ink chambers located only in a vicinity of each of the non-selected ink chambers, the pressure wave can be absorbed effectively.

Moreover, an ejecting pattern may be used to determine the reference voltage. As mentioned above, when the selected ink chambers 44*b* and the non-selected ink chambers 44*b* are alternately located, the influence of the pressure wave is relatively large. From this point of view, the positional condition that the selected ink chambers 44*b* and the non-selected ink chambers 44*b* are alternately located is memorized as an ejecting location pattern. Then, the CPU 91*a* compares locations of the selected ink chambers 44*b* with the ejecting location pattern, and recognizes the number of the selected ink chambers 44*b* that match with the ejecting location pattern. Based on this number of the selected ink chambers 44*b*, the reference voltage Vref is determined. Alternatively, the CPU 91*a* may compare locations of the non-selected ink chambers 44*b* with the ejecting location pattern. Moreover, the comparison of location of the selected or non-selected ink chambers 44*b* and the ejecting location pattern may be partly performed. Moreover, different ejecting location patterns may be used with respect to locations of the ink ejecting holes 45*a*. For example, a special ejecting location pattern may be used for the ink ejecting holes 45*a* located near the edge of the nozzle plate 45.

III. Third Embodiment

Next, a third embodiment of the present invention will be described with reference to FIG. 15. The feature of the third embodiment of the present invention is that the time that the driving voltage V-OFF begins to be increased to +Vt matches with the time that the amplitude of the pressure wave becomes its minimum.

Figure 15:
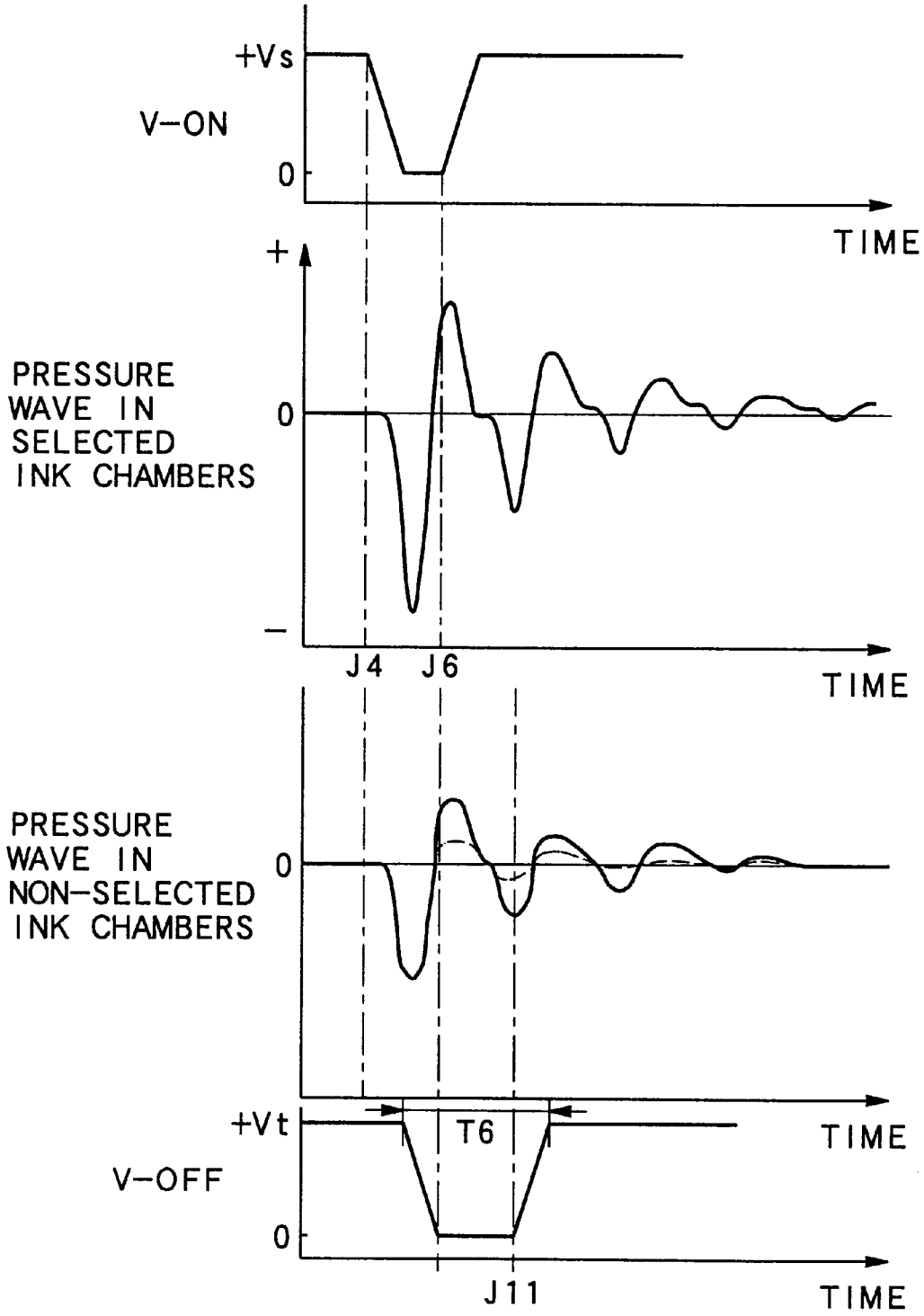
FIG. 15 is a diagram showing driving signals and pressure waves in a third embodiment of the present invention.

As shown in FIG. 15, the amplitude of the pressure wave PW2 or PW3 becomes its maximum, and next, at the time J11, it becomes its minimum. The time J11 can be calculated on the basis of the cycle of the pressure wave PW2 or PW3.

If the volume of each non-selected ink chamber 44*b* is reduced at the time J11, a negative pressure occurring in the non-selected ink chambers 44*b* can be reduced. As a result, the pressure wave PW2 can be effectively restrained, and the time period T6 in the driving voltage V-OFF can be shortened.

Thus, it is possible to sufficiently prevent the leakage of the ink in the case that the resolution is high and the cycle of the change of the driving voltage V-ON is short.

In this case, the gradient of the increase of the driving voltage V-OFF (from 0 to +Vt) is relatively steep. However, the internal pressure of each non-selected ink chamber 44*b* is low at the time J11, because the amplitude of the pressure wave is its minimum at this time. Therefore, the ink stored in the non-selected ink chambers 44*b* does not leak.

According to the third embodiment of the present invention, the driving time period (i.e., the time period T6) can be shortened, for example, can be made less than one cycle of the pressure wave PW2 or PW3. Therefore, it is possible to shorten the cycle of the change of the driving voltage V-ON.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-010850 filed on Jan. 22, 1998 including the specification, claims, drawings and summary is incorporated herein by reference in its entirety.

What is claimed is:

1. An apparatus for ejecting an ink to print images or characters on a recording medium, comprising:

a plate member in which an ink channel is formed;

an ink supplying source for supplying the ink to the ink channel;

a plurality of ink chambers formed in the plate member and each communicating with the ink channel to allow the ink to be moved from the ink channel into the plurality of ink chambers;

a plurality of piezoelectric elements allocated independently each of the plurality of the ink chambers, respectively, to change the volume of each of the plurality of ink chambers;

a plurality of ink ejecting holes formed in the plate member and communicating with the plurality of ink chambers, respectively, to eject the ink from the plurality of ink chambers;

a selection device for selecting more than one of the plurality of ink chambers that actually ejects the ink;

a first control device for reducing a volume of each of the selected ink chambers to actually eject the ink from the selected ink chambers; and a second control device for expanding a volume of each of non-selected ink chambers to absorb a pressure wave which is caused by a change of the volume of each of the selected ink chambers, wherein the first control device includes a first driving voltage supplying device for supplying a first driving voltage to the piezoelectric element corresponding to each of the selected ink chambers to deflect the piezoelectric element corresponding to each of the selected ink chambers, and the second control device includes a second driving voltage supplying device for supplying a second driving voltage to the piezoelectric element corresponding to each of the non-selected ink chambers to deflect the piezoelectric element corresponding to each of the non-selected ink chambers.

2. The apparatus according to claim 1, wherein the second control device expands the volume of each of the non-selected ink chambers at a time that the first control device reduces the volume of each of the selected ink chambers to actually eject the ink.

3. The apparatus according to claim 1, wherein the second control device expands the volume of each of the non-selected ink chambers at a time that an amplitude of the pressure wave reaches its maximum.

4. The apparatus according to claim 1, wherein the second control device reduces the volume of each of the non-selected ink chambers at a time that an amplitude of the pressure wave reaches its minimum, in order to restore the volume of each of the non-selected ink chambers.

5. The apparatus according to claim 1, wherein the second control device determines a degree of an expansion of the volume of each of the non-selected ink chambers, depending on the number of the selected ink chambers.

6. The apparatus according to claim 5, wherein the second control device includes a counting device for counting the number of the selected ink chambers.

7. The apparatus according to claim 6, wherein the counting device counts the number of the selected ink chambers located only in a vicinity of each of the non-selected ink chambers.

8. The apparatus according to claim 1, wherein the second control device determines a degree of an expansion of the volume of each of the non-selected ink chambers, depending on a positional relationship between the selected ink chambers and the non-selected ink chambers.

9. The apparatus according to claim 1, wherein the first driving voltage supplying device supplies the first driving voltage, which has a first level to be set a degree of a change of the volume of each of the selected ink chambers, and which is varied at a first gradient to be set a speed of the change of the volume of each of the selected ink chambers, and the second driving voltage supplying device supplies the second driving voltage, which has a second level less then the first level, or which is varied at a second gradient smaller than the first gradient.

10. The apparatus according to claim 9, wherein the second control device further includes:

a counting device for counting the number of the selected ink chambers; and an adjusting device for adjusting either the second level or the second gradient according to the number of the selected ink chambers counted by the counting device, such that said either the second level or the second gradient is in proportion to the number of the selected ink chambers.

11. The apparatus according to claim 1, wherein the second driving voltage device controls a time to supply the second driving voltage such that a time that a degree of a change of the volume of each of the non-selected ink chambers becomes its maximum matches with a time that an amplitude of the pressure wave reaches its maximum.

12. The apparatus according to claim 11, wherein the second driving voltage supplying device controls the second driving voltage such that a time that the volume of each of the non-selected ink chambers is reduced matches with a time that an amplitude of the pressure wave reaches its minimum.

13. An apparatus for ejecting an ink comprising:

a plate member in which an ink channel is formed;

an ink supplying source for supplying the ink to the ink channel;

a plurality of ink chambers formed in the plate member and each communicating with the ink channel to allow the ink to be moved from the ink channel into the plurality of ink chambers;

a plurality of piezoelectric elements allocated independently to each of the plurality of the ink chambers, respectively to change the volume of each of the plurality of ink chambers;

a plurality of ink ejecting holes formed in the plate member and communicating with the plurality of ink chambers, respectively, to eject the ink from the plurality of ink chambers;

means for selecting more than one of the plurality of ink chambers that actually ejects the ink;

means for expanding a volume of each of the selected ink chambers to move the ink from the ink channel into each of the selected ink chambers;

means for expanding a volume of each of non-selected ink chambers to absorb a pressure wave which is caused by a change of the volume of each of the selected ink chambers;

means for reducing the volume of each of the selected ink chambers to actually eject the ink from the selected ink chambers; and means for reducing the volume of each of the non-selected ink chambers to restore the volume of each of the non-selected ink chambers;

wherein means for reducing the volume of each of the selected ink chambers includes a first driving voltage supplying means for supplying a first driving voltage to the piezoelectric element corresponding to each of the selected ink chambers to deflect the piezoelectric element corresponding to each of the selected ink chambers, and means for expanding a volume of each of non-selected ink chambers includes a second driving voltage supplying means for supplying a second driving voltage to the piezoelectric element corresponding to each of the non-selected ink chambers to deflect the piezoelectric element corresponding to each of the non-selected ink chambers.

14. A method of ejecting an ink for an ink ejecting apparatus comprising: a plate member in which an ink channel is formed; an ink supplying source for supplying the ink to the ink channel; a plurality of ink chambers formed in the plate member and each communicating with the ink channel to allow the ink to be moved from the ink channel into the plurality of ink chambers; means for expanding a volume of each of non-selected ink chambers; a plurality of piezoelectric elements allocated independently to each of the plurality of the ink chambers, respectively, to change the volume of each of the plurality of ink chambers; and a plurality of ink ejecting holes formed in the plate member and communicating with the plurality of ink chambers, respectively, to eject the ink from the plurality of ink chambers, the method comprising the processes of:

selecting more than one of the plurality of ink chambers that actually ejects the ink;

expanding a volume of each of the selected ink chambers to move the ink from the ink channel into each of the selected ink chambers;

expanding a volume of each of non-selected ink chambers to absorb a pressure wave which is caused by a change of the volume of each of the selected ink chambers;

reducing the volume of each of the selected ink chambers to actually eject the ink from the selected ink chambers; and reducing the volume of each of the non-selected ink chambers to restore the volume of each of the non-selected ink chambers, wherein the process of reducing the volume of each of the selected ink chambers includes a first driving voltage supplying process of supplying a first driving voltage to the piezoelectric element corresponding to each of the selected ink chambers to deflect the piezoelectric element corresponding to each of the selected ink chambers, and the process of expanding a volume of each of non-selected ink chambers includes a second driving voltage supplying process of supplying a second driving voltage to the piezoelectric element corresponding to each of the non-selected ink chambers to deflect the piezoelectric element corresponding to each of the non selected ink chambers.

15. The method according to claim 14, wherein the volume of each of the non-selected ink chambers is expanded at a time that the volume of each of the selected ink chambers is reduced.

16. The method according to claim 14, wherein the volume of each of the non-selected ink chambers is expanded at a time that the ink is actually ejected from the selected ink chambers.

17. The method according to claim 14, wherein the volume of each of the non-selected ink chambers is expanded at a time that an amplitude of the pressure wave reaches its maximum.

18. The method according to claim 14, wherein a degree of an expansion of the volume of each of the non-selected ink chambers is determined, depending on the number of the selected ink chambers.

19. The method according to claim 14, wherein a degree of an expansion of the volume of each of the non-selected ink chambers is determined, depending on a positional relationship between the selected ink chambers and the non-selected ink chambers.

* * * * *